US007237298B2

(12) United States Patent
Reindle et al.

(10) Patent No.: US 7,237,298 B2
(45) Date of Patent: Jul. 3, 2007

(54) SENSORS AND ASSOCIATED METHODS FOR CONTROLLING A VACUUM CLEANER

(75) Inventors: Mark E. Reindle, Sagamore Hills, OH (US); Bruce R. Knox, Kirkland Hills, OH (US); Norman Siegel, Mentor, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 633 days.

(21) Appl. No.: 10/665,709

(22) Filed: Sep. 19, 2003

(65) Prior Publication Data

US 2005/0065662 A1 Mar. 24, 2005

(51) Int. Cl.
*A47L 9/28* (2006.01)

(52) U.S. Cl. ..... 15/319; 15/377; 15/383; 15/340.1; 15/340.3

(58) Field of Classification Search ..... 15/319, 15/339

See application file for complete search history.

(56) References Cited

U.S. PATENT DOCUMENTS

| | | | | |
|---|---|---|---|---|
| 4,245,370 | A * | 1/1981 | Baker | 15/319 |
| 4,294,595 | A * | 10/1981 | Bowerman | 15/339 |
| 4,558,215 | A | 12/1985 | Kaneko et al. | |
| 4,654,924 | A * | 4/1987 | Getz et al. | 15/319 |
| 4,733,431 | A * | 3/1988 | Martin | 15/339 |
| 5,109,566 | A | 5/1992 | Kobayashi et al. | |
| 5,279,672 | A | 1/1994 | Betker et al. | |
| 5,321,614 | A | 6/1994 | Ashworth | |
| 5,341,540 | A | 8/1994 | Soupert et al. | |

(Continued)

FOREIGN PATENT DOCUMENTS

EP 1149332 B1 8/2003

(Continued)

OTHER PUBLICATIONS

Home Appliances, Vacuum Cleaners, SG2039/D,REV 0, Apr. 2003, Motorola, Inc. (6 pages).

(Continued)

*Primary Examiner*—Theresa T. Snider
(74) *Attorney, Agent, or Firm*—Fay Sharpe LLP

(57) ABSTRACT

Several methods of controlling a vacuum cleaner (10) using various types of sensors (94, 96, 97, 98) are provided. One method is based on a differential pressure between a suction airflow path and ambient air and includes: detecting the differential pressure, comparing the detected differential pressure to a predetermined threshold, and, when the detected differential pressure is less than the predetermined threshold, initiating a predetermined control procedure. A status indicator (164) is updated based on the detected differential pressure. Another method is based on a level of electrical current flowing through a brush motor (100). Still another method is based on a type or condition of the floor being traversed. Yet another method is based on a distance to a surface of a floor over which the vacuum cleaner is advancing. In another aspect of the invention, a vacuum cleaner is provided. In various combinations, the vacuum cleaner includes a vacuum source (36, 38), a brush motor (100), a drive motor (104), a controller processor (74), a sensor processor (90), an overcurrent sensor (98), a suction airflow sensor (94), a floor type sensor (97), and a floor distance sensor (96).

20 Claims, 13 Drawing Sheets

U.S. PATENT DOCUMENTS

| | | | | |
|---|---|---|---|---|
| 5,377,106 | A | 12/1994 | Drunk et al. | |
| 5,542,146 | A | 8/1996 | Hoekstra et al. | |
| 5,613,261 | A | 3/1997 | Kawakami et al. | |
| 5,634,237 | A | 6/1997 | Paranjpe | |
| 5,722,109 | A * | 3/1998 | Delmas et al. | 15/319 |
| 5,778,486 | A * | 7/1998 | Kim | 15/339 |
| 5,940,927 | A | 8/1999 | Haegermarck et al. | |
| 6,026,539 | A * | 2/2000 | Mouw et al. | 15/339 |
| 6,076,227 | A | 6/2000 | Schallig et al. | |
| 6,105,202 | A * | 8/2000 | Grasso et al. | 15/319 |
| 6,351,872 | B1 * | 3/2002 | McCormick | 15/339 |
| 6,467,123 | B1 * | 10/2002 | Di Nunzio et al. | 15/339 |
| 6,493,612 | B1 | 12/2002 | Bisset et al. | |
| 6,571,415 | B2 | 6/2003 | Gerber et al. | |
| 6,571,422 | B1 | 6/2003 | Gordon et al. | |
| 6,590,222 | B1 | 7/2003 | Bisset et al. | |
| 6,594,844 | B2 | 7/2003 | Jones | |
| 6,671,592 | B1 | 12/2003 | Bisset et al. | |
| 6,832,407 | B2 * | 12/2004 | Salem et al. | 15/319 |
| 6,836,930 | B2 * | 1/2005 | Thur et al. | 15/339 |
| 2002/0189045 | A1 | 12/2002 | Mori et al. | |

FOREIGN PATENT DOCUMENTS

| | | |
|---|---|---|
| WO | WO 00/38027 | 6/2000 |
| WO | WO 2005/077240 | 8/2005 |

OTHER PUBLICATIONS

The New York Times, www.nytimes.com, "It Mulches, Too? Robotic Mowers Gain in Appeal" by John R. Quain, Jul. 31, 2003 (3 pages).

H.R. Everett, Sensors for Mobile Robots, Theory and Application, Naval Command, Control and Ocean Surveillance Center, San Diego, California, A.K. Peters, Ltd. 1995, pp. 15-17 and 93-101.

Joseph L. Jones et al., Mobile Robots , Inspiration to Implementation, Second Edition, A.K. Peters, Ltd. 1999, pp. 120-134.

* cited by examiner

SENSORS AND ASSOCIATED METHODS FOR CONTROLLING A VACUUM CLEANER

BACKGROUND OF INVENTION

The invention relates to methods of controlling a vacuum cleaner using various types of sensors. It finds particular application in conjunction with a robotic vacuum having a controller, a cleaning head, and an interconnecting hose assembly and will be described with particular reference thereto. However, it is to be appreciated that the invention is also amenable to other applications. For example, a traditional upright vacuum cleaner, a traditional canister vacuum cleaner, a carpet extractor, other types of vacuum cleaners, and other types of robotic vacuums. More generally, this invention is amenable to various types of robotic household appliances, both indoor, such as floor polishers, and outdoor, such as lawnmowers or window washing robots.

It is well known that robots and robot technology can automate routine household tasks eliminating the need for humans to perform these repetitive and time-consuming tasks. Currently, technology and innovation are both limiting factors in the capability of household cleaning robots. Computer processing power, battery life, electronic sensors such as cameras, and efficient electric motors are all either just becoming available, cost effective, or reliable enough to use in autonomous consumer robots.

Generally, there are two standard types of vacuums: upright and canister. Uprights tend to be more popular because they are smaller, easier to manipulate and less expensive to manufacture. Conversely, the principal advantage of canister vacuums is that, while the canister may be more cumbersome, the cleaning head is smaller. A few patents and published patent applications have disclosed self-propelled and autonomous canister-like vacuum cleaners.

Much of the work on robotic vacuum technology has centered on navigation and obstacle detection and avoidance. The path of a robot determines its success at cleaning an entire floor and dictates whether or not it will get stuck. Some proposed systems have two sets of orthogonal drive wheels to enable the robot to move directly between any two points to increase its maneuverability. Robotic vacuum cleaners have mounted the suction mechanisms on a pivoting or transverse sliding arm so as to increase the reach of the robot. Many robotic vacuums include methods for detecting and avoiding obstacles.

For example, U.S. Pat. No. 6,226,830 to Hendriks et al. and assigned to Philips Electronics discloses a canister-type vacuum cleaner with a self-propelled canister. The vacuum cleaner also includes a conventional cleaning head and a hose assembly connecting the cleaning head to the canister. The canister includes an electric motor, a caster wheel, two drive wheels, a controller, and at least one touch or proximity sensor. The controller controls at least the direction of at least one of the drive wheels. As a user operates the vacuum cleaner and controls the cleaning head, the sensors in the canister detect obstacles and the controller controls the canister to avoid the obstacles.

U.S. Pat. No. 6,370,453 to Sommer discloses an autonomous service robot for automatic suction of dust from floor surfaces. The robot is controlled so as to explore the adjacent area and to detect potential obstacles using special sensors before storing them in a data field. The displacement towards a new location is then carried out using the stored data until the whole accessible surface has been covered. One of the main constituent members of the robot includes an extensible arm that rests on the robot and on which contact and range sensors are arranged. When the robot is used as an automatic vacuum cleaner, airflow is forced into the robot arm. When one or more circular rotary brushes are provided at the front end of the arm, the cleaning effect is enhanced.

U.S. Pat. No. 6,463,368 to Feiten et al. discloses a self-propelled vacuum cleaner. The vacuum cleaner includes a pivotable arm and a cable to connect to an electrical receptacle for power. The arm includes a plurality of tactile sensors to recognize obstacles by touching the obstacle with the arm. The vacuum cleaner also includes a processor and a memory connected via a bus. An identified and traversed path is stored in an electronic map in the memory. Every obstacle identified on the path is entered in the map. The vacuum cleaner includes a cable drum for winding up the cable. The cable drum includes a motor to drive the cable drum for unwinding or winding the cable. The vacuum cleaner also includes a steering mechanism, wheels, and a motor for driving the vacuum cleaner along the path.

PCT Published Patent Application No. WO 02/074150 to Personal Robotics discloses a self-propelled canister vacuum cleaner. In one embodiment, the vacuum cleaner is autonomous. In another embodiment, the self-propelled vacuum cleaner is powered by standard utility power via a power cord. The canister vacuum cleaner includes a cleaning head module, a vacuum fan module (i.e., canister), and a hose assembly connecting the cleaning head module with the vacuum fan module. The vacuum fan module includes a controller that performs navigation and control functions for both the vacuum fan module and the cleaning head module. Alternatively, the controller may be separated from the vacuum fan module and the cleaning head module, and can be mobile. The vacuum fan module and the cleaning head module each include a drive mechanism for propulsion. The cleaning head module includes a cleaning brush assembly that can be motorized or air driven. The cleaning head module may also include a microcontroller that communicates with the controller.

However, none of the current robotic canister-like vacuum cleaners sense suction airflow, floor distance using light wave sensors, floor type using sonic wave sensors, or brush motor current.

U.S. Pat. No. 5,109,566 to Kobayashi et al. discloses a self-running cleaning apparatus with a floor sensor composed of an ultrasonic sensor for sensing the kind of floor surface, such as a carpet or a bare floor, and the state of the floor, such as a concave or convex floor.

U.S. Pat. No. 5,279,672 to Betker et al. discloses an automatic controlled cleaning machine with an infrared drop-off avoidance transmitter and receiver combination.

U.S. Pat. No. 5,321,614 to Ashworth discloses a navigational control apparatus with a plurality of vertical switches connected to a vehicle frame at various points around its periphery. The vertical switches each preferably comprise an electromagnetic switch that contacts the surface of the work area as the vehicle is driven there along and is capable of producing an obstacle signal when surface contact is lost due to a vertical drop greater than a predetermined magnitude. Other sensor means such as opto-electrical proximity sensors may also be employed in place of the electromechanical contact switches.

U.S. Pat. No. 5,341,540 to Soupert et al. discloses an autonomous apparatus for the automatic cleaning of ground areas. At least one sensor may be disposed at the front of the apparatus. This sensor may be of the infrared type and is placed and oriented beneath the apparatus towards the ground area in order to detect a break therein.

U.S. Pat. No. 5,377,106 to Drunk et al. discloses an unmanned vehicle with drop monitoring sensors aimed in a vertical direction detecting increases in the distance between their position and that of the floor traveled on by the vehicle. The drop monitoring sensors are preferably infrared sensors.

U.S. Pat. No. 5,634,237 to Paranjpe discloses a self-guided, self-propelled, convertible cleaning apparatus with a micro controller system that continuously monitors the condition of a suction motor. If the suction motor gets overloaded, the suction motor is stopped and a buzzer is sounded to alert the operator.

U.S. Pat. No. 5,940,927 to Haegermarck et al. discloses an autonomous surface cleaning apparatus. An electronic control device is provided for control of a drive motor associated with a brush roller. If the movement of the brush roller is blocked or obstructed to a predetermined extent, the control device is arranged to stop the brush roller motor and then transitorily activate the motor in the opposite direction and finally, after another stop, to reconnect the brush roller motor to operate in the original direction of rotation.

U.S. Pat. No. 6,493,612 to Bisset et al. discloses an autonomous vehicle, such as a robotic cleaning device, with downward looking wheel sensors that sense the presence of a surface in front of the wheels. Another sensor is provided at or near a leading edge of the vehicle for sensing the presence beneath the leading edge of the vehicle. The vehicle is arranged so that movement of the vehicle is possible if the leading edge sensor senses that there is no surface beneath the leading edge of the vehicle, provided that the wheel sensors indicate that there is a surface adjacent to the wheel. When the leading edge sensor senses that there is no surface beneath the leading edge of the vehicle, the vehicle performs an edge following routine.

U.S. patent application Publication No. US 2002/0189045 to Mori et al. discloses a self-moving cleaner with a level sensor that detects a difference in level of a surface to be cleaned. The level sensor is preferably an infrared sensor and is mounted to each corner of a main body in a manner to face slantingly downward.

U.S. Pat. No. 6,076,227 to Schallig et al. and assigned to Philips discloses an electrical surface treatment device with an acoustic surface type detector. The surface type detector delivers an output signal during operation which is characteristic of the type of surface to be treated and which is determined by a value of a physical quantity of air vibrations reflected by the surface to be treated which value is measured by a vibration detector of the surface type detector. In a special embodiment the physical quantity is an amplitude and the surface type detector is a vibration generator for generating air vibrations having a predetermined amplitude. The generated air vibrations preferably have a frequency of at least 15,000 Hz which varies within a predetermined range.

Thus, there is a particular need for an improved robotic canister-like vacuum cleaner the improvements of which apply to various types of vacuum cleaners, as well as other household appliances, both indoor and outside.

BRIEF SUMMARY OF INVENTION

The invention contemplates a robotic canister-like vacuum cleaner, as well as other types of vacuum cleaners, that overcome at least one of the above-mentioned problems and others.

In one aspect of the invention, a method of controlling a vacuum cleaner is provided. In one embodiment, the method includes: a) detecting a differential pressure between a suction airflow path associated with the vacuum cleaner and ambient air near the vacuum cleaner, b) comparing the detected differential pressure to a first predetermined threshold, c) when the detected differential pressure is less than the first predetermined threshold, initiating a first predetermined control procedure, and d) updating a status indicator based on the detected differential pressure.

In another embodiment, the method includes: a) detecting a level of electrical current flowing through a brush motor associated with the vacuum cleaner, b) comparing the detected brush motor current to a predetermined threshold, c) when the detected brush motor current is greater than the predetermined threshold, removing power from the brush motor and disabling operation of the brush motor until power is manually reset, and d) when the detected brush motor current is not greater than the predetermined threshold, repeating steps a)-c).

In still another embodiment, the method includes: a) emitting sonic energy toward a floor being traversed by the vacuum cleaner, b) detecting sonic energy reflected by the floor, c) comparing the detected sonic energy to a predetermined threshold, d) when the detected sonic energy exceeds the predetermined threshold, initiating a first predetermined control procedure, e) when the detected sonic energy does not exceed the predetermined threshold, initiating a second predetermined control procedure, and f) repeating steps a)-e).

In still yet another embodiment, the method includes: a) emitting sonic energy toward a floor being traversed by the vacuum cleaner, b) detecting the sonic energy reflected by the floor, c) comparing the detected sonic energy to at least one of a plurality of values in a lookup table (LUT), wherein each LUT value represents at least one of a type and a condition of a floor, d) determining at least one of the type and condition of the floor being traversed by matching the detected sonic energy to an LUT value, and e) initiating a predetermined control procedure based on the type of floor being traversed.

In another embodiment, the method includes: a) emitting light energy toward a floor over which the vacuum cleaner is advancing, b) detecting the light energy reflected by the floor, c) comparing the detected light energy to a predetermined threshold to determine a distance to a surface of the floor, d) when the detected light energy is less than the predetermined threshold, initiating a predetermined control procedure, and e) periodically repeating steps a) through d) while the vacuum cleaner is being propelled.

In another aspect of the invention, a vacuum cleaner is provided. In one embodiment, the vacuum cleaner includes a suction airflow sensor, a sensor processor, a vacuum source, and a controller processor. The suction airflow sensor includes a differential pressure sensor. In another embodiment, the vacuum cleaner also includes a brush motor, a brush motor overcurrent sensor, and a reset switch. In an alternate embodiment, the vacuum cleaner also includes a brush motor and a floor type sensor. In another alternate embodiment, the vacuum cleaner also includes a floor distance sensor and a drive motor.

Benefits and advantages of the invention will become apparent to those of ordinary skill in the art upon reading and understanding the description of the invention provided herein.

BRIEF DESCRIPTION OF DRAWINGS

The invention is described in more detail in conjunction with a set of accompanying drawings, wherein.

DETAILED DESCRIPTION

Figure 1:
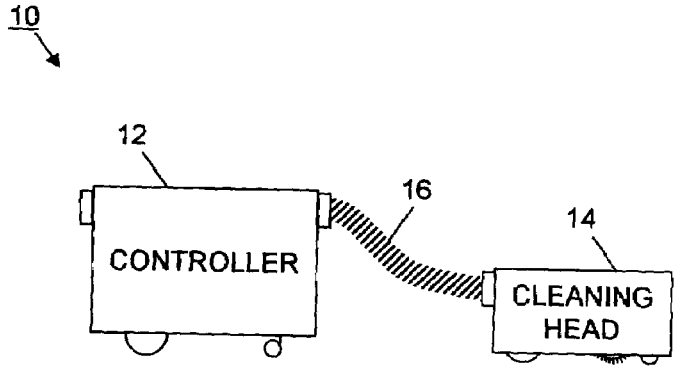
FIG. 1 is a functional block diagram of an embodiment of a robotic canister-like vacuum cleaner according to the present invention.

While the invention is described in conjunction with the accompanying drawings, the drawings are for purposes of illustrating exemplary embodiments of the invention and are not to be construed as limiting the invention to such embodiments. It is understood that the invention may take form in various components and arrangement of components and in various steps and arrangement of steps beyond those provided in the drawings and associated description. Within the drawings, like reference numerals denote like elements. It is to be appreciated that the invention is amenable to various applications. For example, a traditional upright vacuum cleaner, a traditional canister vacuum cleaner, a carpet extractor, other types of vacuum cleaners, and other types of robotic vacuums. More generally, this invention is amenable to various types of robotic household appliances, both indoor, such as floor polishers, and outdoor, such as lawnmowers or window washing robots.

With reference to FIG. 1, an embodiment of a robotic vacuum 10 includes a controller 12, a cleaning head 14 and a hose 16. The robotic vacuum 10 somewhat resembles conventional canister vacuum cleaners and may be referred to herein as a robotic canister-like vacuum, for the sake of convenience.

The controller 12 is in fluidic communication with the cleaning head 14 via a hose 16 for performing vacuuming functions. The controller is also in operative communication with the cleaning head 14 with respect to control functions. Essentially, in the embodiment being described, the controller 12 and the cleaning head 14 are separate housings and cooperate by moving in tandem across a surface area to vacuum dirt and dust from the surface during robotic operations. Typically, the cleaning head 14 acts as a slave to the controller 12 for robotic operations. Since the cleaning head 14 is separate from the controller 12 in a tandem configuration, the cleaning head 14 can be significantly smaller than the controller 12 and smaller than known one-piece robotic vacuums. The small cleaning head 14 is advantageous because it can access and clean small or tight areas, including under and around furniture.

The controller 12 performs mapping, localization, planning and control for the robotic vacuum 10. Typically, the controller 12 "drives" the robotic vacuum 10 throughout the surface area. While the controller is performing this function, it may also learn and map a floor plan for the surface area including any existing stationary objects. This includes: i) detecting characteristics of the environment, including existing obstacles, using localization sensors, ii) mapping the environment from the detected characteristics and storing an environment map in a controller processor 74 (FIG. 4), iii) determining a route for the robotic vacuum 10 to traverse in order to clean the surface area based on the environment map, and iv) storing the route for future reference during subsequent robotic operations. Thus, the controller 12 provides the robotic vacuum 10 with an automated environment-mapping mode. Automated environment mapping allows the vacuuming function to be performed automatically in future uses based on the mapped environment stored in the controller 12.

Figure 2:
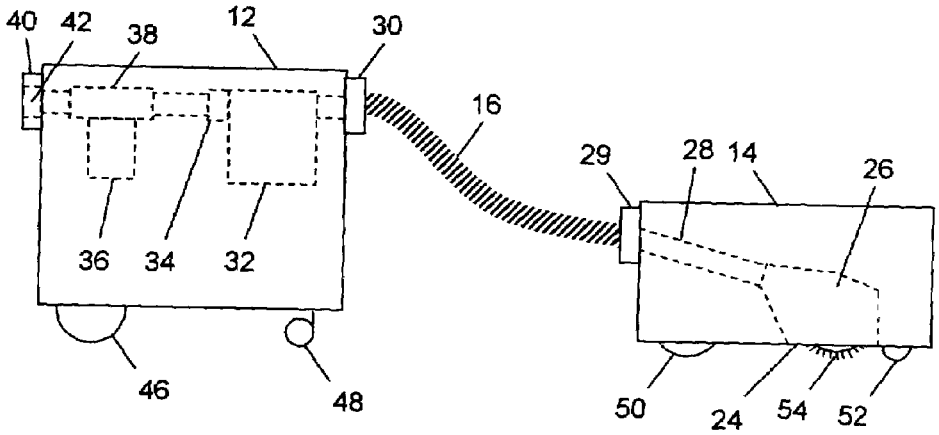
FIG. 2 is a functional block diagram showing a suction airflow path in an embodiment of a robotic canister-like vacuum cleaner of FIG. 1.

With reference to FIG. 2, various functions of the major components of the robotic vacuum 10 are shown, including the suction airflow path associated with vacuuming functions. The cleaning head 14 includes a suction inlet 24, a brush chamber 26, a suction conduit 28 and a cleaning head outlet 29. The controller 12 includes a vacuum inlet 30, a dirt receptacle 32, a primary filter 34, a suction motor 36, a suction fan 38, a vacuum outlet 40 and a secondary filter 42. As is well known, the suction fan 38 is mechanically connected to the suction motor 36. The suction fan 38 creates an airflow path by blowing air through the vacuum outlet 40. Air is drawn into the airflow path at the suction inlet 24. Thus, a suction airflow path is created between the suction inlet 24 and the suction fan 38. The vacuum or lower pressure in the suction airflow path also draws dirt and dust particles in the suction inlet 24. The dirt and dust particles flow through the hose 16 and are retained in the dirt receptacle 32. The dirt receptacle 32 may be dirt cup or a disposable bag, depending on whether a bag-less or bagged configuration is implemented.

Additionally, as shown in FIG. 2, the controller 12 can include at least one wheel 46 and a caster 48. The cleaning head 14 can also include at least one wheel 50, a caster 52 and a rotating brush roll 54, as is known in the art. Typically, the controller 12 and the cleaning head 14 both include two wheels and one or two casters. However, additional wheels, and/or additional casters may be provided. Likewise, tracked wheels can be used in addition to or in place of the wheels and casters. The wheels are driven to provide self-propelled movement. If the wheels (e.g., 46) are independently controlled, they may also provide steering. Otherwise, one or more of the casters (e.g., 48) may be controlled to provide steering. The configuration of wheel and casters in the cleaning head 14 may be the same or different from the configuration in the controller 12. Likewise, movement and steering functions in the cleaning head 14 may be implemented in the same manner as movement and steering functions in the controller 12, or in a different manner. For vacuuming, depending on the floor type, the brush 54 rotates and assists in the collection of dirt and dust particles.

Figure 3:
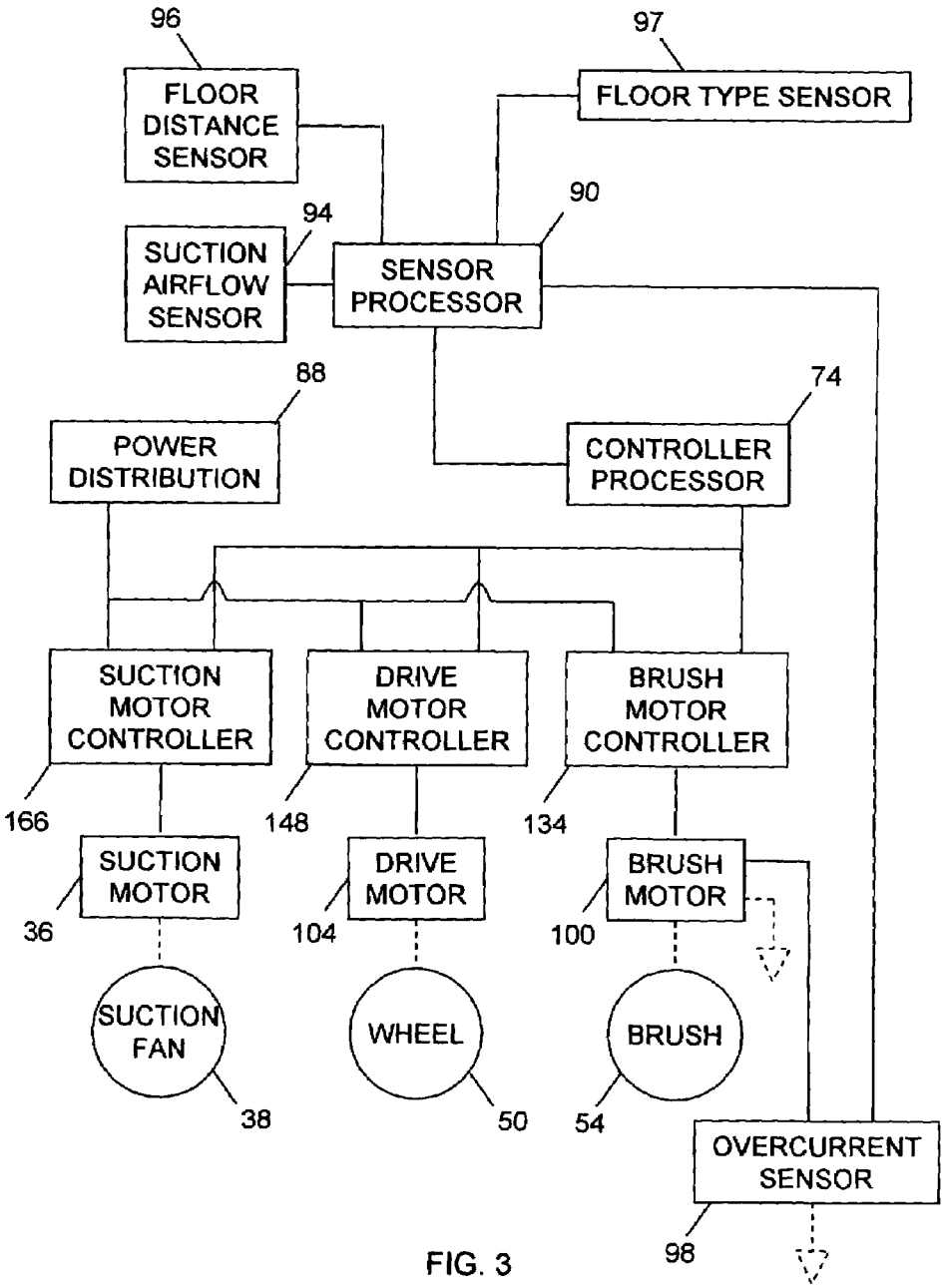
FIG. 3 is a functional block diagram of an embodiment of a robotic vacuum cleaner according to the present invention.

With reference to FIG. 3, an embodiment of the robotic vacuum cleaner 10 includes the suction motor 36, suction fan 38, wheel 50, brush 54, a controller processor 74, a power distribution 88, a sensor processor 90, a suction airflow sensor 94, a floor distance sensor 96, a floor type sensor 97, a brush motor overcurrent sensor 98, a brush motor 100, a drive motor 104, a brush motor controller 134, a drive motor controller 148, and a suction motor controller 166. In one embodiment, the brush 54 and the brush motor 100 can be combined to form a belt-less brush motor. In a belt-less brush motor, as is known, the motor is housed in the brush. An exemplary sensor processor 90 includes a microcontroller model no. PIC18F252 manufactured by Microchip Technology, Inc., 2355 West Chandler Blvd., Chandler, Ariz. 85224-6199.

Power distribution 88 receives power from a power source and distributes power to other components of the vacuum cleaner 10 including the controller processor 74, sensor processor 90, brush motor controller 134, drive motor controller 148, and suction motor controller 166. The power source, for example, may be located in the controller 12 or in the cleaning head 14; or divided between both the controller 12 and the cleaning head 14. Power distribution 88 may be a terminal strip, discreet wiring, or any suitable combination of components that conduct electrical power to the proper components. For example, if any components within the vacuum cleaner 10 require a voltage, frequency, or phase that is different than that provided by the power source, power distribution 88 may include power regulation, conditioning, and/or conversion circuitry suitable to provide the required voltage(s), frequencies, and/or phase(s). In one embodiment, the power source is in the controller 12 (FIG. 2) and provides power to the cleaning head 14. In this embodiment, power is distributed from the controller 12 (FIG. 2) along wires within the hose 16 (FIGS. 1 and 2) to power distribution 88 for distribution throughout the cleaning head.

The sensor processor 90 processes information detected by the suction airflow sensor 94, floor distance sensor 96, floor type sensor 97, and overcurrent sensor 98. The sensor processor 90, for example, can be in communication with the controller processor 74 via discrete control signals communicated through hose 16 (FIGS. 1 and 2). The controller processor 74 can control the brush 54, wheel(s) 50, and suction fan 38 via brush motor controller 134, drive motor controller 148, and suction motor controller 166, respectively. Alternatively, the controller processor 74 may control one or more motors directly or via any type of suitable known device.

The suction airflow sensor 94, in combination with the sensor processor 90, detects if there is an obstruction in the suction airflow path of the vacuum cleaner. If there is an obstruction, the sensor processor 90 issues a visual indication via LED and a control signal to the controller processor 74 to shut the suction motor 36 off. If the suction motor 36 is not shut off when there is an obstruction in the suction airflow path, the suction motor 36 increases its speed. This can cause catastrophic failure to the suction motor 36 and potentially to the vacuum cleaner 10. The suction airflow sensor can be calibrated to be used as a maintenance sensor (for example clean filter, empty dirt receptacle, or change bag).

The suction airflow sensor 94, in combination with the sensor processor 90, detects an obstruction in the suction airflow path. In one embodiment, the suction airflow sensor 94 performs a differential pressure measurement between ambient air and the suction airflow path. In this embodiment, one of the differential pressure ports of the suction airflow sensor 94 is tapped to the atmosphere and the other port includes tapped to the suction airflow path. An exemplary differential pressure sensor includes model no. MPS5010 manufactured by Motorola, Inc. The sensor processor 90 can distinguish between a foreign object obstruction condition, a full dirt receptacle 32 (FIG. 2), and when the primary filter 34 (FIG. 2) needs to be changed. If desired, the sensor processor 90 can communicate the detected conditions to the controller processor 74 and the controller processor can determine whether the suction motor 36 (FIG. 2), brush motor 100 and drive motors 104 should be shut down or controlled differently and/or whether associated indicators should be illuminated and/or annunciators (i.e., alarms) should be sounded. Once the controller processor 74 determines a course of action, it communicates appropriate instructions to the appropriate motor controllers (i.e., 134, 148, 166).

In self-propelled vacuum cleaners, particularly a robotic vacuum cleaner, catastrophic failure will occur if stairs or other potential height changes in floor surfaces are not detected. To this end, the floor distance sensor 96, in combination with the sensor processor 90, detects height changes in floor surfaces and issues a control signal to the controller processor 74 for a stop and reverse command so that the vacuum cleaner 10 does not tumble down the stairs.

The floor distance sensor 96, in combination with the sensor processor 90, detects a drop-off in the floor that would cause the cleaning head 14 to hang up or fall. For example, the floor distance sensor 96 detects when the cleaning head 14 is at the top of a staircase or when the cleaning head approaches a hole or substantial dip in the surface area being traversed. In one embodiment, the floor distance sensor 96 can include two infrared (IR) sensors mounted approximately 5 cm off the ground at about a 20° angle normal to vertical. An exemplary IR floor distance sensor includes Sharp model no. GP2D120 manufactured by Sharp Corp., 22-22 Nagaiko-Cho, Abeno-Ku, Osaka 545-8522, Japan. The floor distance sensor 96 can communicate information to the sensor processor 90. In turn, the sensor processor 90 can communicate the detected conditions to the controller processor 74. The controller processor 74 controls the drive motors 104 to maneuver, for example, the cleaning head 14 in order to avoid the surface area when a hazardous surface condition is detected.

In combination with the sensor processor 90, the floor type sensor 97 can detect if a floor is carpeted or not. This is important since typically it is preferred to shut off the brush 54 if the vacuum cleaner is on a bare floor (e.g., hardwood floors, etc.) to protect the floor from damage caused by the brush.

The floor type sensor 97, in combination with the sensor processor 90, detects the type of floor being traversed and distinguishes between carpeted and non-carpeted surfaces. Floor type information is communicated to the controller processor 74. Typically, the controller processor 74 operates the brush motor 100 to spin the brush 54 when the surface area is carpeted and stops the brush motor 100 when non-carpeted surfaces are being cleaned. In one embodiment, the floor type sensor can use sonar to detect floor type. If used, a sonar floor type sensor can be mounted approximately 3 inches off the floor and can run at approximately 16 KHz. Using this arrangement, the sonar sensor can distinguish between, for example, low cut pile carpet and linoleum. An exemplary sonar floor type sensor includes model no. ps/mt/m8/420/d manufactured by Marco Systemanalyse und Entwicklung GmbH, Hans-Böckler-Str.2, D-85221 Dachau, Germany.

The overcurrent sensor 98, in combination with the sensor processor 90, can detect an unsafe current level in the brush motor 100. In operation, the vacuum cleaner 10 has the potential of picking up items (e.g., rags, throw rugs, etc.) that can jam the brush 54. When this happens the brush motor 100 can be in a locked rotor position causing the current and the motor to rise beyond its design specifications. An overcurrent sensor, in combination with the sensor processor 90, can detect this condition and turn off the brush motor 100 to avoid the potentially hazardous condition.

The overcurrent sensor 98, in combination with the sensor processor 90, can provide locked rotor and overcurrent protection to the brush motor 100. If the brush motor 100, for example, jams, brush motor current is increased. In one embodiment, the overcurrent sensor 98 can be an overcurrent feedback module associated with the brush motor 100. For example, if the brush motor is a brushless DC motor, the overcurrent feedback module can sense motor RPMs. Similarly, if the brush motor is a servo motor, the overcurrent feedback module can sense average torque on the motor. Additionally, the overcurrent feedback module may be an encoder that detects and measures movement of the brush motor shaft. In another embodiment, the overcurrent sensor 98 can be an electronic circuit that senses brush motor current and, in combination with the sensor processor 90, removes power from the brush motor 100 when an overcurrent condition is sensed. The overcurrent sensor 98 can be reset after, for example, a throw rug jamming the brush 54 is removed from the suction inlet 24 (FIG. 2). Also, the sensor processor 90 may communicate the overcurrent condition information to the controller processor so that additional appropriate actions can be taken during in overcurrent condition. For example, such actions can be stopping movement of the robotic vacuum 10 and activation of appropriate indicators and/or alarms.

Either the controller processor 74 or the sensor processor 90 can control drive functions for the cleaning head 14. The controller processor 74 is in communication with the drive motor 104 and associated steering mechanism. In one embodiment, the steering mechanism may move the caster 52 (FIG. 2) to steer the cleaning head 14. The drive motor 104 is in operative communication with the wheel 50 to turn the wheel forward or backward to propel the cleaning head 14. In another embodiment, the drive motor 104 may simultaneously control two wheels 50 and the steering mechanism may control the caster 52 (FIG. 2).

Figure 9:
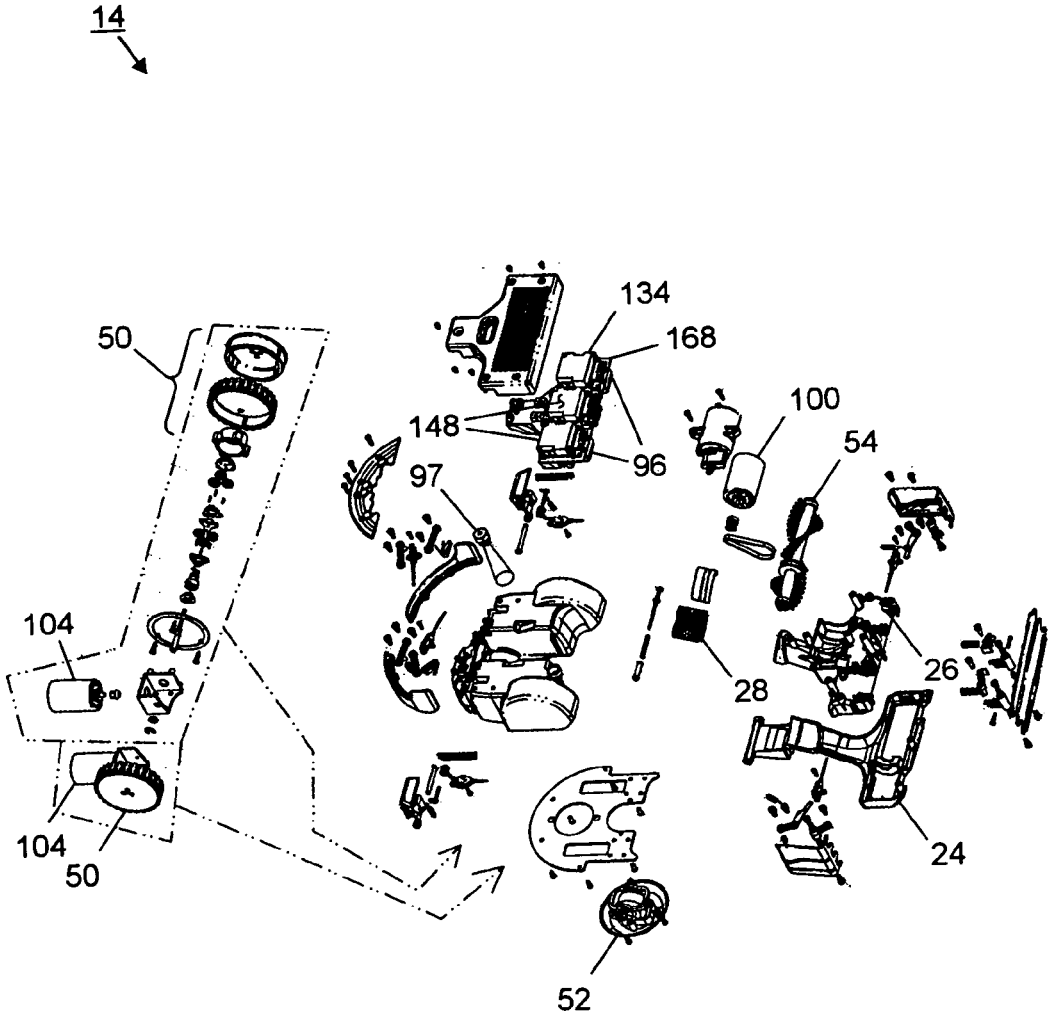
FIG. 9 is an exploded view an embodiment of a cleaning head associated with the robotic canister-like vacuum cleaner of FIGS. 1 and 2.

In still another embodiment, having two casters 54 (FIG. 2), the steering mechanism controls may control both casters independently or by a linkage between the casters. Alternatively, the additional caster may be free moving (i.e., freely turning about a vertical axis). If the cleaning head 14 includes additional casters, they may be free moving or linked to the steered caster(s). In yet another embodiment, as shown in FIG. 9, the cleaning head 14 can include two independent drive motors 104 and the processor can independently control the two wheels 50 to provide both movement and steering functions. In this embodiment, each independently controlled drive motor 104/wheel 50 combination provides forward and backward movement. For this embodiment, the controller processor 74 would control steering by driving the drive motor 104/wheel 50 combinations in different directions and/or at different speeds. Thus, a separate steering mechanism is not required.

The wheel 46, caster 48, and drive motor of the controller 12 (FIG. 2) typically operate in the same manner as like components described above for the cleaning head 14. Likewise, the various alternatives described above for the drive and steering components in the cleaning head 14 are available for the drive and steering components in the controller 12. It should also be appreciated that the wheel 46, caster 48, and drive motor of the controller 12 may implement one of the alternatives described above while the cleaning head 14 implements a different alternative.

In various embodiments, the functions performed by the controller processor 74 and sensor processor 90 may be combined in one or more processors or divided differently among two or more processors. The resulting processor(s) may be located in the controller 12 or the cleaning head 14 or divided between the controller 12 and the cleaning head 14. In the embodiment being described, the controller 12 and cleaning head 14 are typically assembled in separate housings. The various components depicted in FIG. 3 may be installed in either housing, unless the function of the component dictates that it must be installed in either the controller 12 or the cleaning head 14. For example, the brush 54 and brush motor 100 typically must be installed in the cleaning head. Alternatively, the components depicted in FIG. 3 may be embodied in a robotic vacuum cleaner having a single housing rather than the tandem configuration shown in FIGS. 1 and 2.

Figure 4:
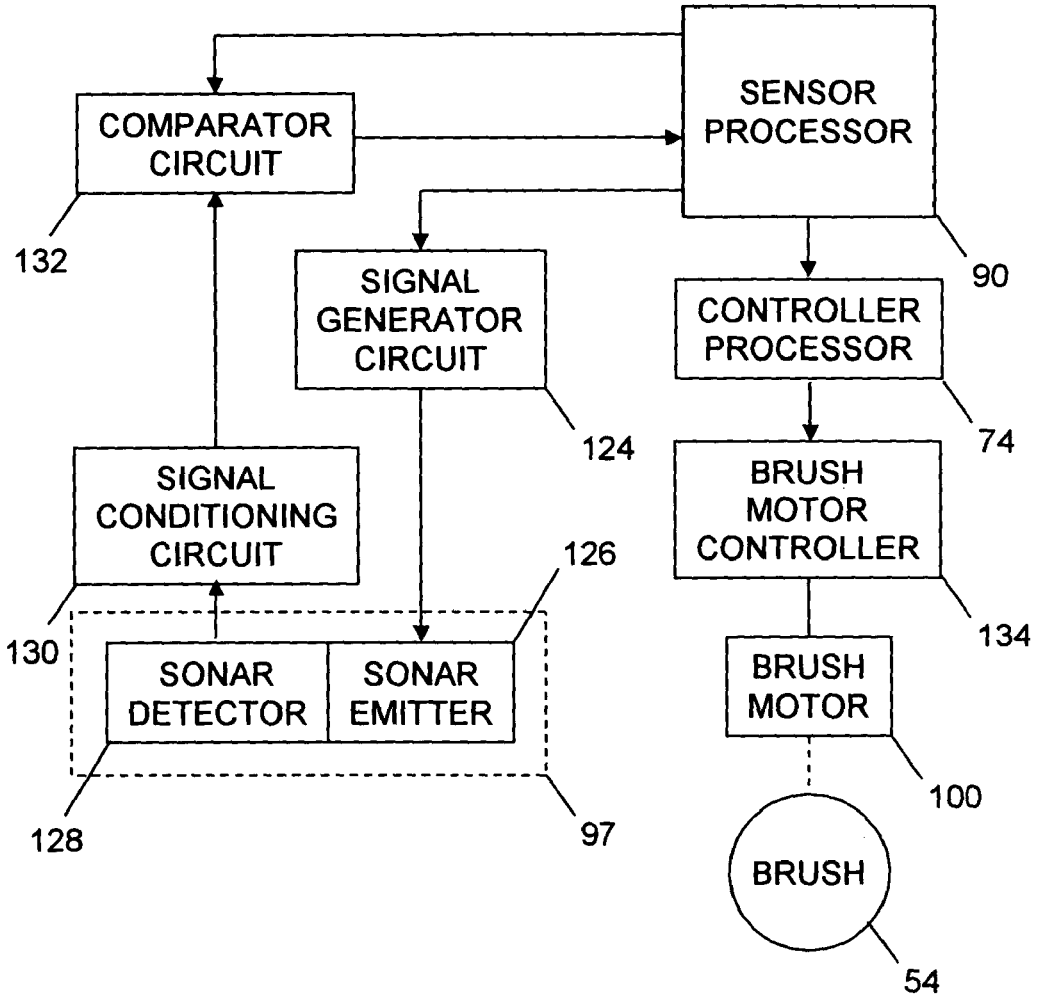
FIG. 4 is a more detailed functional block diagram of an embodiment of a vacuum cleaner circuit including a floor type sensor of FIG. 3.

With reference to FIG. 4, a vacuum cleaner circuit with a floor type sensor 97 also includes the brush 54, controller processor 74, sensor processor 90, brush motor 100, brush motor controller 134, a signal generator circuit 124, a signal conditioning circuit 130, and a comparator circuit 132. In one embodiment, the floor type sensor 97 is based on sonar technology and includes a sonar emitter 126 and a sonar detector 128.

The sensor processor 90 can communicate a control signal to the signal generator circuit 124. In turn, the signal generator circuit 124 can provide a drive signal to the sonar emitter 126. The control and drive signals may, for example, be about 416 KHz. Normally, the drive signal would be a high voltage stimulus that causes the sonar emitter 126 to emit sonic energy in the direction of the floor to be sensed. Such energy is either reflected (in the case of a hard floor) or partially absorbed and scattered (in the case of a soft or carpeted floor). The reflected sonic energy is received by the sonar detector 128 and converted to an electrical signal provided to the signal conditioning circuit 130. In turn, the signal conditioning circuit 130 conditions and filters the detected signal so that it is compatible with the comparator circuit 132. If desired, the comparator circuit 132 can be programmable and can receive a second input from the sensor processor 90. The input from the sensor processor 90 can act as a threshold for comparison to the detected signal. One or more predetermined threshold values may be stored in the sensor processor 90 and individually provided to the comparator circuit 132. The output of the comparator circuit 132 can be monitored by the sensor processor 90.

The comparator circuit 132 may be implemented by hardware or software. For example, in one embodiment the sensor processor 90 may include a look-up table (LUT) and a comparison process may include matching the detected signal to values in the look-up table where values in the look-up table identify thresholds for the detected signal for various types of floor surfaces. For example, hard floor surfaces, such as concrete, laminate, ceramic, and wood, and soft floor surfaces, such as sculptured carpet, low pile carpet, cut pile carpet, and high pile carpet.

The sensor processor 90 identifies the type of floor being traversed by the vacuum cleaner and communicates type of floor information to the controller processor 74. Based on the type of floor information, the controller processor 74 determines whether or not to operate the brush motor and provides a control signal to the brush motor controller 134 to start or stop the brush motor 100. The controller processor 74 may also control the speed of the brush motor 10 via the brush motor controller 134 if variations in speed, based on the type of floor detected, are desirable.

The brush motor controller 134, brush motor 100, and brush 54 operate as described above in relation to FIG. 3. In an alternate embodiment the brush motor controller 134 may not be required and either the controller processor 74 or the sensor processor 90 may directly control the brush motor 100. In still another embodiment, the sensor processor 90 may directly control the brush motor controller 134.

The vacuum cleaner circuit with the floor type sensor which has been described above, may be implemented in a robotic vacuum cleaner, a robotic canister-like vacuum cleaner, a hand vacuum cleaner, a carpet extractor, a canister vacuum cleaner, an upright vacuum cleaner, and similar indoor cleaning appliances (e.g., floor scrubbers) and outdoor cleaning appliances (e.g., street sweepers) that include rotating brushes.

Figure 5:
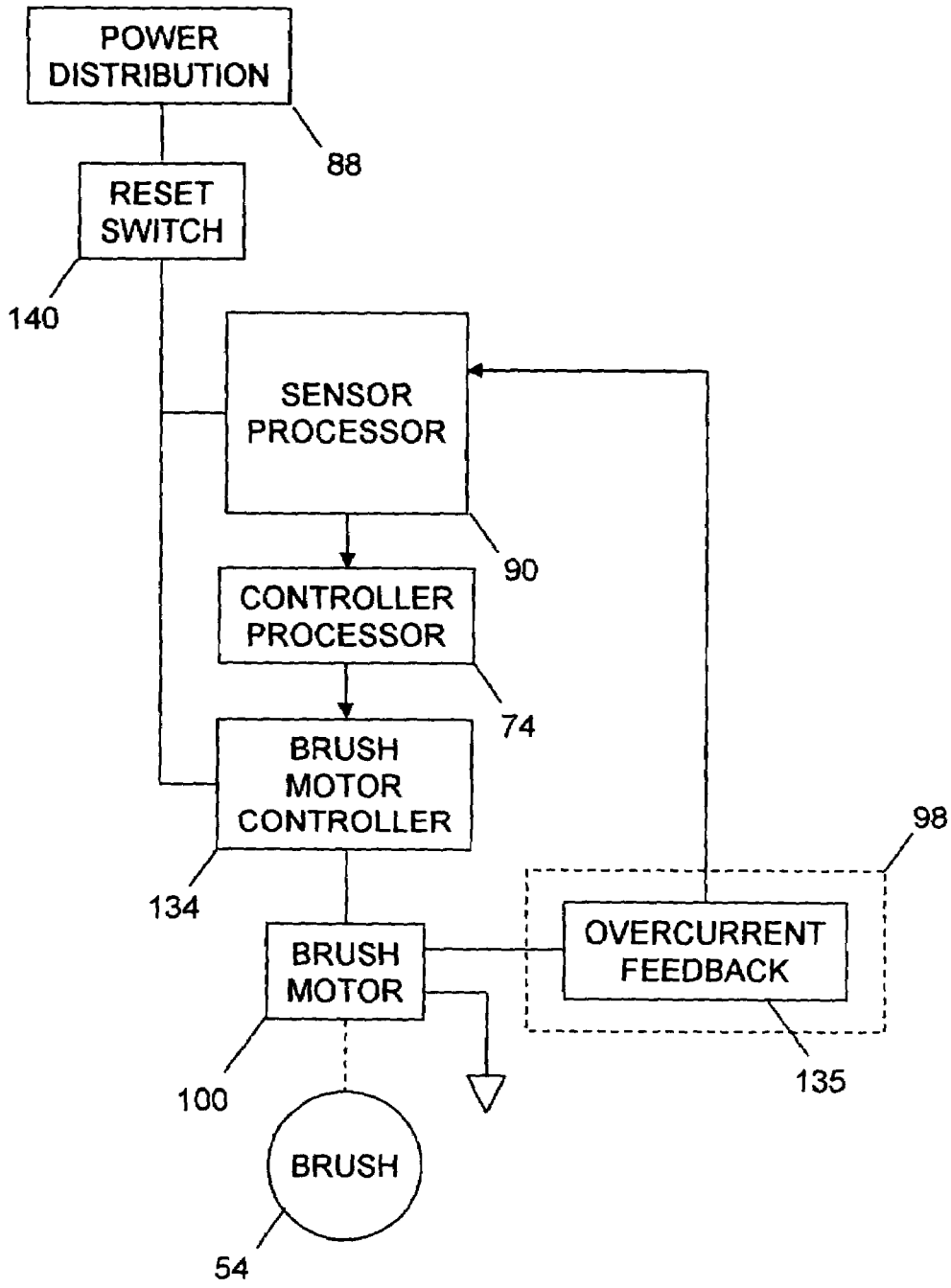
FIG. 5 is a more detailed functional block diagram of an embodiment of a vacuum cleaner circuit including a brush motor overcurrent sensor of FIG. 3.

With reference to FIG. 5, a vacuum cleaner circuit with a brush motor overcurrent sensor 98 also includes the brush 54, controller processor 74, power distribution 88, sensor processor 90, brush motor 100, brush motor controller 134 and a reset switch 140. In one embodiment, the overcurrent sensor 98 includes an overcurrent feedback module 135. The overcurrent feedback module 135, for example, may provide information associated with brush motor RPM, brush motor torque, quantity of brush motor revolutions, and/or distance of brush motor rotation. For example, where the brush motor is a brushless DC motor, the overcurrent feedback module 135 may provide information associated with brush motor RPM. Alternatively, where the brush motor is a servo motor, the overcurrent feedback module 135 may provide information associated with brush motor torque. For various types of brush motors, the overcurrent feedback module 135 may include, for example, encoders that provide information associated with the quantity of brush motor revolutions from a given point and/or the distance of brush motor rotation from a given point.

During operation of the brush motor 100, power flows from power distribution 88 through the reset switch 140 and the brush motor controller 134 to the brush motor 100. In the embodiment being described, the return path for power is connected to the brush motor 100. The sensor processor 90 monitors, for example, brush motor RPM via the overcurrent feedback module 135 and determines whether an overcurrent condition exists based on the brush motor RPM. The sensor processor 90 may, alternatively, monitor brush motor torque, brush motor revolutions, or distance of brush motor rotation as described above. The sensor processor 90 can compare the information provided by the overcurrent feedback module 135 to a predetermined threshold. If the feedback information is less than the predetermined threshold, the sensor processor 90 can send a control signal to the controller processor 74 and/or brush motor controller 134 to open the power connection to the brush motor 100. In the embodiment being described, the brush motor controller 134 remains open until the reset switch 140 is manually activated, thereby cycling power to the brush motor controller 134 and applying a control activation signal to the sensor processor 90. In other embodiments, the brush motor controller 134 may be reset by other suitable means. Once power is cycled by activation of the reset switch 140, the sensor processor 90 sends a control signal to close the power connection in the brush motor controller 134, thus enabling power to flow to the brush motor 100 through the brush motor controller 134.

The sensor processor 90 may communicate conditions associated with brush motor current to the controller processor 74. In turn, the controller processor 74 may use brush motor current information to control operation of the brush motor 100, including on/off and/or speed control. The brush motor controller 134, brush motor 100, and brush 54 can operate in the same manner as described above in reference to FIG. 3.

The vacuum cleaner circuit with the brush motor overcurrent sensor may be implemented in a robotic vacuum cleaner, a robotic canister-like vacuum cleaner, a hand vacuum cleaner, a carpet extractor, a canister vacuum cleaner, an upright vacuum cleaner, and similar household cleaning appliances that include a brush motor.

Figure 6:
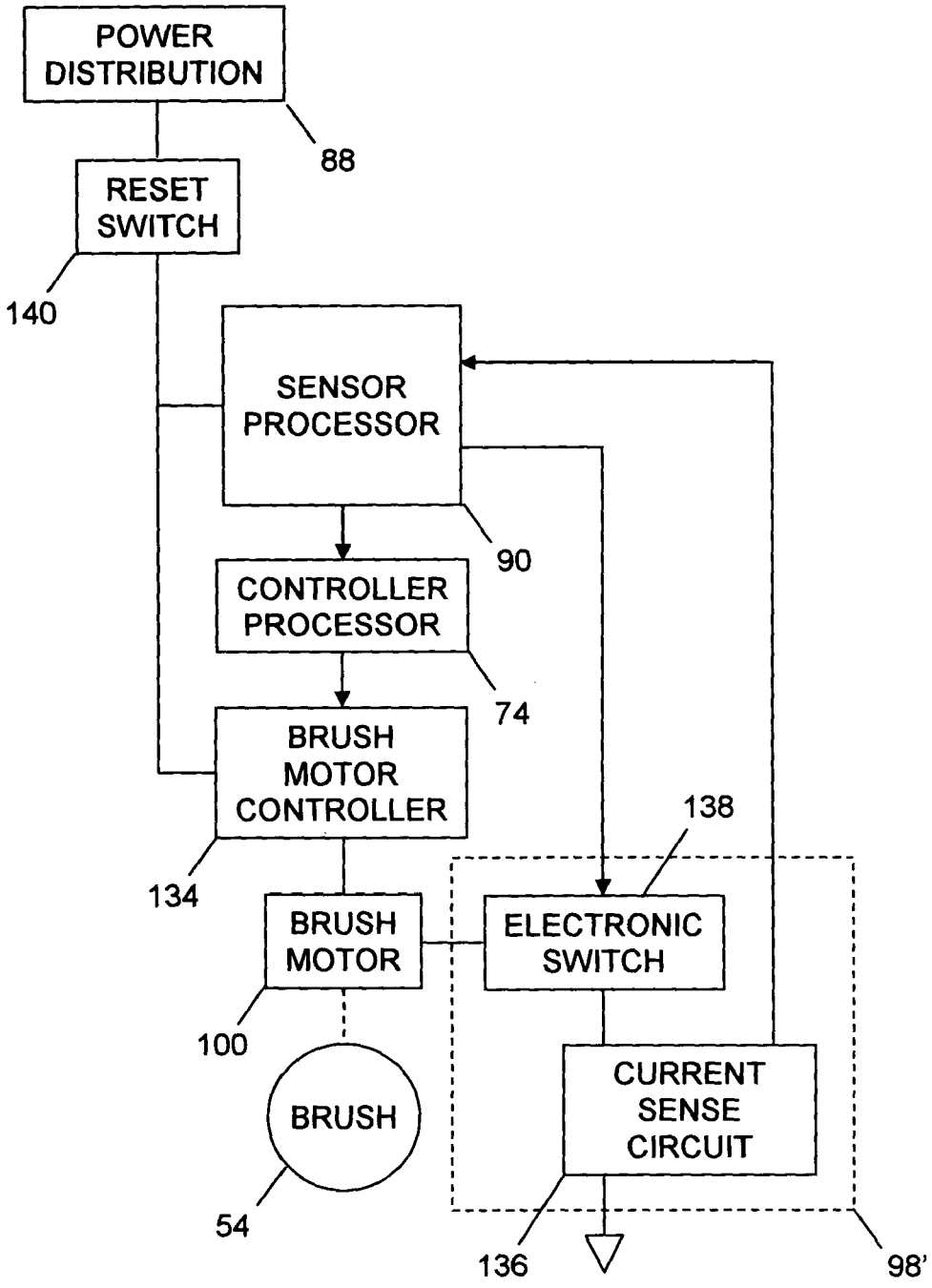
FIG. 6 is a functional block diagram of another embodiment of a vacuum cleaner circuit including the brush motor overcurrent sensor of FIG. 3.

With reference to FIG. 6, another embodiment of a vacuum cleaner circuit with a brush motor overcurrent sensor 98' also includes the brush 54, controller processor 74, power distribution 88, sensor processor 90, brush motor 100, brush motor controller 134 and a reset switch 140. In one example of the embodiment being described, the overcurrent sensor 98' includes a current sense circuit 136 and an electronic switch 138. An exemplary current sense circuit 136 includes a 0.05 ohm resistor, a 1K ohm resistor, and a 0.1 μF capacitor. An exemplary electronic switch 138 includes a field effect transistor (FET), a 1K ohm resistor, and a 10K ohm resistor.

During operation of the brush motor 100, power flows from power distribution 88 through the reset switch 140 and the brush motor controller 134 to the brush motor 100. In the embodiment being described, the overcurrent sensor 98' is in the return path between the brush motor 100 and ground. In other embodiments, the overcurrent sensor 98' may be located at other points in the brush motor current path. The sensor processor 90 monitors brush motor current via the current sense circuit 136. This circuit may include a current sense resistor that converts motor current to a voltage signal that is filtered and provided to the sensor processor 90. The sensor processor 90 can compare the sensed current to a predetermined threshold. If the sensed current exceeds the predetermined threshold, the sensor processor 90 can send a control signal to the electronic switch 138 to open the return path for power to the brush motor 100. In the embodiment being described, the electronic switch 138 remains open until the reset switch 140 is manually activated, thereby cycling power to the brush motor controller 134 and applying a control activation signal to the sensor processor 90. In other embodiments, the electronic switch 138 may be reset by other suitable means. Once power is cycled by activation of the reset switch 140, the sensor processor 90 sends a control signal to close the electronic switch 138, thus enabling power to flow through the brush motor 100 via the brush motor controller 134 under control of the controller processor 74 and sensor processor 90.

The sensor processor 90 may communicate conditions associated with brush motor current to the controller processor 74. In turn, the controller processor 74 may use brush motor current information to control operation of the brush motor 100, including on/off and/or speed control. The brush motor controller 134, brush motor 100, and brush 54 can operate in the same manner as described above in reference to FIG. 3.

The vacuum cleaner circuit with the brush motor overcurrent sensor may be implemented in a robotic vacuum cleaner, a robotic canister-like vacuum cleaner, a hand vacuum cleaner, a carpet extractor, a canister vacuum cleaner, an upright vacuum cleaner, and similar household cleaning appliances that include a brush motor.

Figure 7:
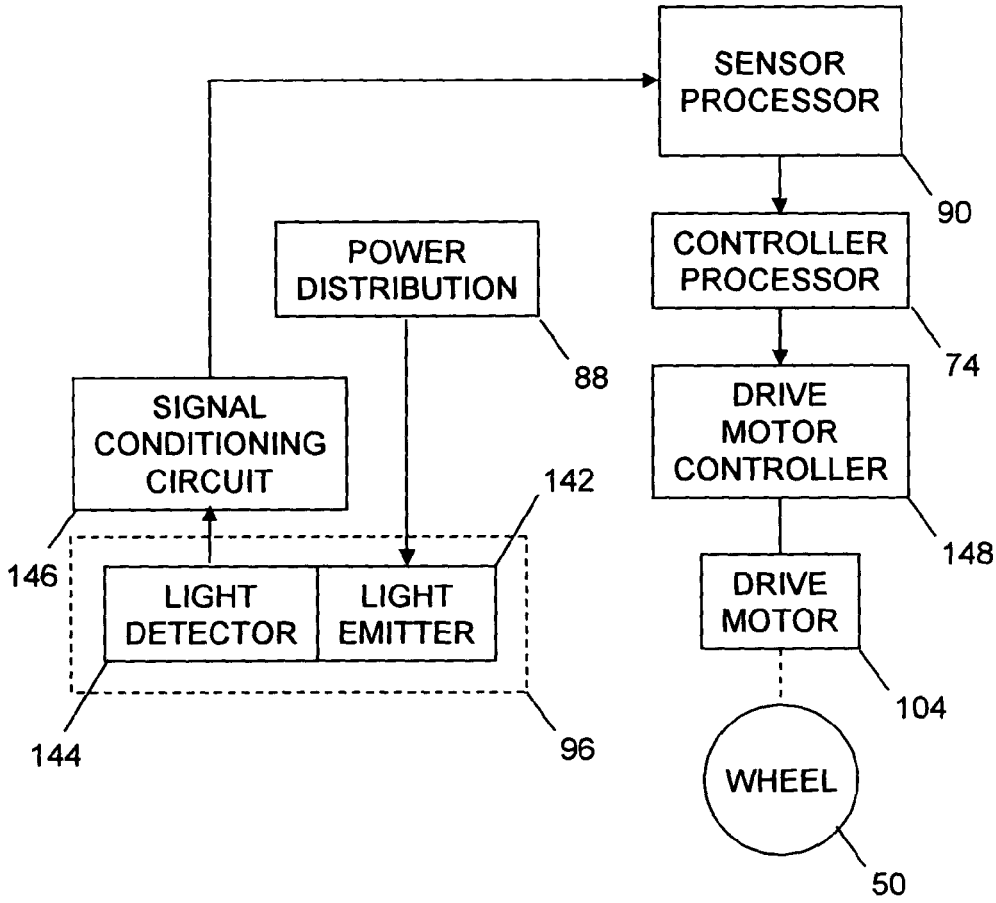
FIG. 7 is a more detailed functional block diagram of an embodiment of a vacuum cleaner circuit including a floor distance sensor of FIG. 3.

In reference to FIG. 7, a vacuum cleaner circuit with a floor distance sensor 96 also includes the wheel 50, controller processor 74, power distribution 88, sensor processor 90, drive motor 104, drive motor controller 148 and signal conditioning circuit 146. In one embodiment, the floor distance sensor includes a light emitter 142 and a light detector 144.

The power distribution 88 applies power to the light emitter 142. The light emitter 142 emits light energy toward a surface of a floor toward which the vacuum cleaner is advancing. Detecting the amount of light reflected by the floor is the light detector 144. The amount of light detected is indicative of the distance to the surface of the floor. Providing a detected signal to the signal conditioning circuit 146 is the light detector 144. The signal conditioning circuit 146 conditions and filters the signal for the sensor processor 90. Comparing the conditioned signal to a predetermined threshold is the sensor processor 90 to determine if there is a sudden increase in the distance, such as would occur when the vacuum cleaner approaches the edge of a downward staircase. The specific values of this distance threshold are programmable and dependent on sensor mounting and view angles. Two floor distance sensors 96 can be mounted on opposite edges of the vacuum cleaner to detect a stair edge when the vacuum cleaner is moving at any angle to a drop-off in the surface of the floor.

The sensor processor 90 identifies conditions in the floor surface that may be hazardous for a self-propelled vacuum cleaner. These potential hazardous conditions are communicated to the controller processor 74. The controller processor 74 controls the drive motor controller 148, which in turn controls the speed and direction of the drive motor 104 so that the vacuum cleaner avoids the potential hazardous condition. For example, when a potential hazardous condition is detected, the controller processor 74 may implement a control procedure that stops the vacuum cleaner from advancing, reverses the vacuum cleaner to back away from the potential hazardous surface condition, and activates localization sensors to localize the vacuum cleaner within the environment to be cleaned. Alternatively, the controller processor 74 may implement an edge following routine using the floor distance sensor 96 to advance the vacuum cleaner along the edge of the potentially hazardous surface condition. If desired, the drive motor controller 148, drive motor 104, and wheel 50 can operate in the same manner as described above in reference to FIG. 3. Likewise, as described above, multiple pairs of drive motors 104 and wheels 50 can be implemented and independently controlled to steer the vacuum cleaner. Alternatively, a steering mechanism can be implemented and controlled in conjunction with control of the drive motor 104 to avoid the potentially hazardous condition.

The vacuum cleaner circuit with the floor distance sensor may be implemented in a robotic vacuum cleaner, a robotic canister-like vacuum cleaner, a self-propelled carpet extractor, a self-propelled canister vacuum cleaner, a self-propelled upright vacuum cleaner, and similar cleaning units (e.g., street sweeper, lawn mower, floor polisher) that are self-propelled.

Figure 8:
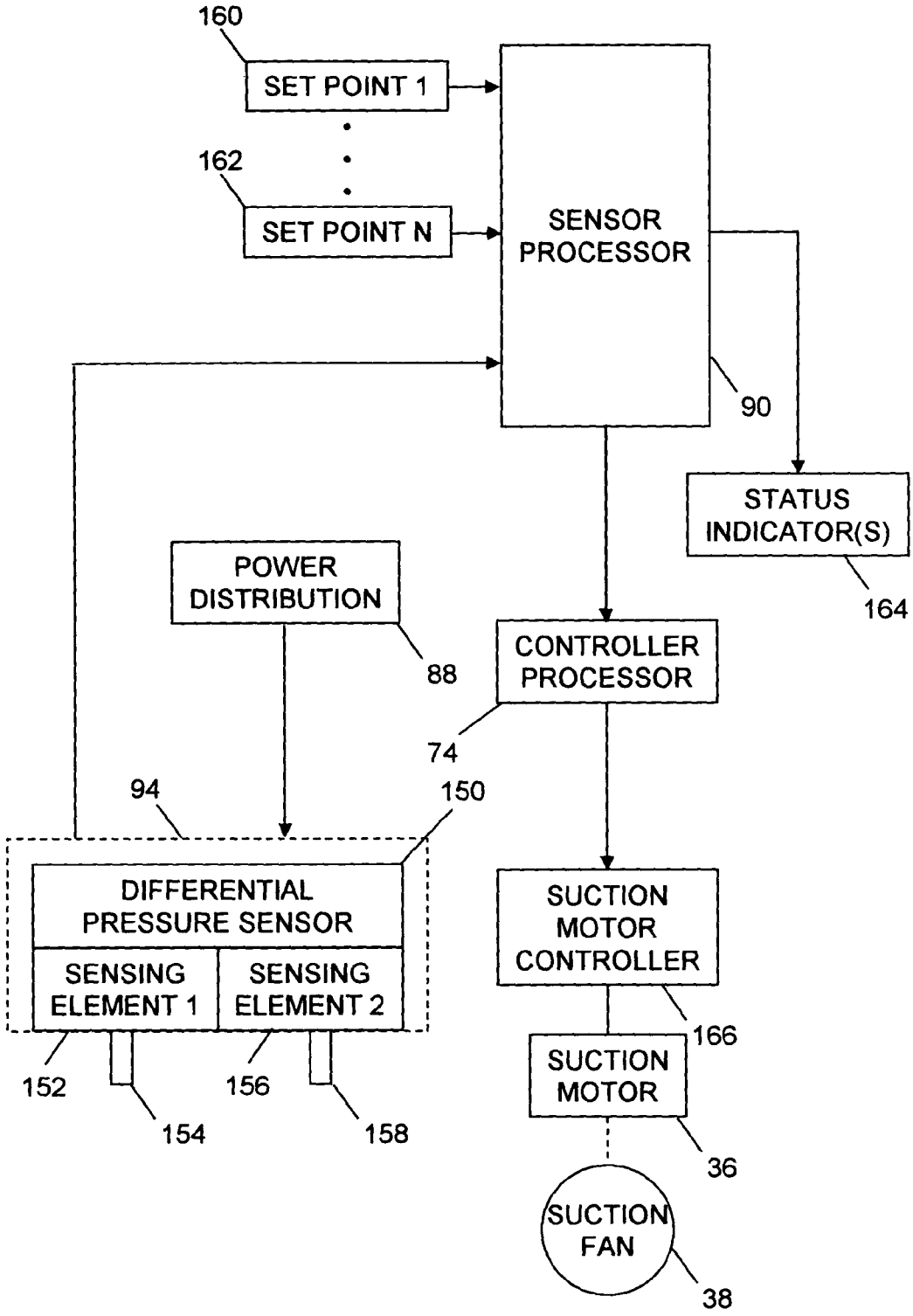
FIG. 8 is a more detailed functional block diagram of an embodiment of a vacuum cleaner circuit including a suction airflow sensor of FIG. 3.

With reference to FIG. 8, a vacuum cleaner circuit with a suction airflow sensor 94 also includes the suction motor 36, suction fan 38, controller processor 74, power distribution 88, sensor processor 90, suction motor controller 166, a plurality of set points (including a first set point 160 and an Nth set point 162), and one or more status indicator(s) 164. In one embodiment, the suction airflow sensor 94 includes a differential pressure sensor 150 with a first sensing element 152, a first pressure sensing port 154, a second sensing element 156, and a second pressure sensing port 158. The first sensing port 154 is associated with the first sensing element 152 and the second sensing port 158 is associated with the second sensing element 156.

The differential pressure sensor 150 converts a difference in pressure across the two sensing ports to a signal that is provided to the sensor processor 90. The sensor processor 90 compares the sensed signal to one or more predetermined set points (160, 162). Any or all set points can be implemented in hardware (e.g., variable resistors) or software. Depending on the results of the comparison, the sensor processor 90 updates the one or more status indicators 164 to reflect the sensed differential pressure.

One sensing port (e.g., 154) can measure the pressure in the suction airflow path and the other sensing port (e.g., 158) can measure the pressure of ambient air near the vacuum cleaner. The difference in pressure can be used to determine varying degrees of obstruction within the suction airflow path. For example, individual set points (e.g., 160, 162) can be calibrated to represent thresholds for differential pressure measurements that are expected when the suction airflow path is obstructed by a foreign object, when a dirt receptacle associated with the vacuum cleaner is generally full, and when a filter associated with the vacuum cleaner is generally blocked. In other words, the first set point 160 may be adjusted to act as a threshold for determining when the suction airflow path is obstructed by a foreign object, a second set point may be adjusted to act as a threshold for determining when the dirt receptacle is generally full, and a third set point may be adjusted to act as a threshold for determining when the filter is generally blocked.

The status indicator 164 may include an illuminated indicator, an annunciator, or a combination of both. If the sensor processor 90 can identify multiple conditions for the vacuum cleaner based on different differential pressure measurements, it is preferred that the status indicator be able to provide multiple types of indicator sequences with a unique indicator sequence associated with each unique detectable condition. The illuminated indicator can have multiple illuminated display sequences and the annunciator can have multiple audible tone sequences.

For example, the illuminated indicator may include a tri-color LED with red, yellow, and green sections. The sensor processor 90 may illuminate the red section when the suction airflow path is obstructed by a foreign object and the yellow section when the dirt receptacle is generally full. The sensor processor 90 may illuminate and flash the yellow section when the filter is generally blocked, and the green section when the suction airflow path is suitable for normal vacuuming operations. Of course, alternate color schemes and alternate display characteristics are also possible. The annunciator may be used in combination with the illuminated indicator or in place of the illuminated indicator. Similarly, the sensor processor 90 can control the annunciator to sound unique audible tone sequences for each detectable condition.

The vacuum cleaner circuit with the suction airflow sensor may be implemented in a robotic vacuum cleaner, a robotic canister-like vacuum cleaner, a hand vacuum cleaner, a carpet extractor, a canister vacuum cleaner, a stick vacuum cleaner, an upright vacuum cleaner, and any other type of cleaning unit (e.g., street sweeper) that includes a suction airflow path.

With reference to FIG. 9, an exploded view of an embodiment of a cleaning head 14 associated with a canister-like vacuum cleaner 10 is provided. This view shows the suction inlet 24, brush chamber 26, suction conduit 28, two wheels 50, caster 52, brush 54, two floor distance sensors 96, a floor type sensor 97, a brush motor 100, two drive motors 104, a brush motor controller 134, two drive motor controllers 148, and a circuit card assembly 168. The circuit card assembly 168 may include various components and one or more of the electronic circuits described above, including the sensor processor 90, suction airflow sensor 94; and overcurrent sensor 98. Of course, electronic circuits and various components could be divided among multiple circuit card assemblies in any suitable manner. Similarly, the circuit card assemblies may be disposed in any suitable location throughout the vacuum cleaner.

Figure 10:
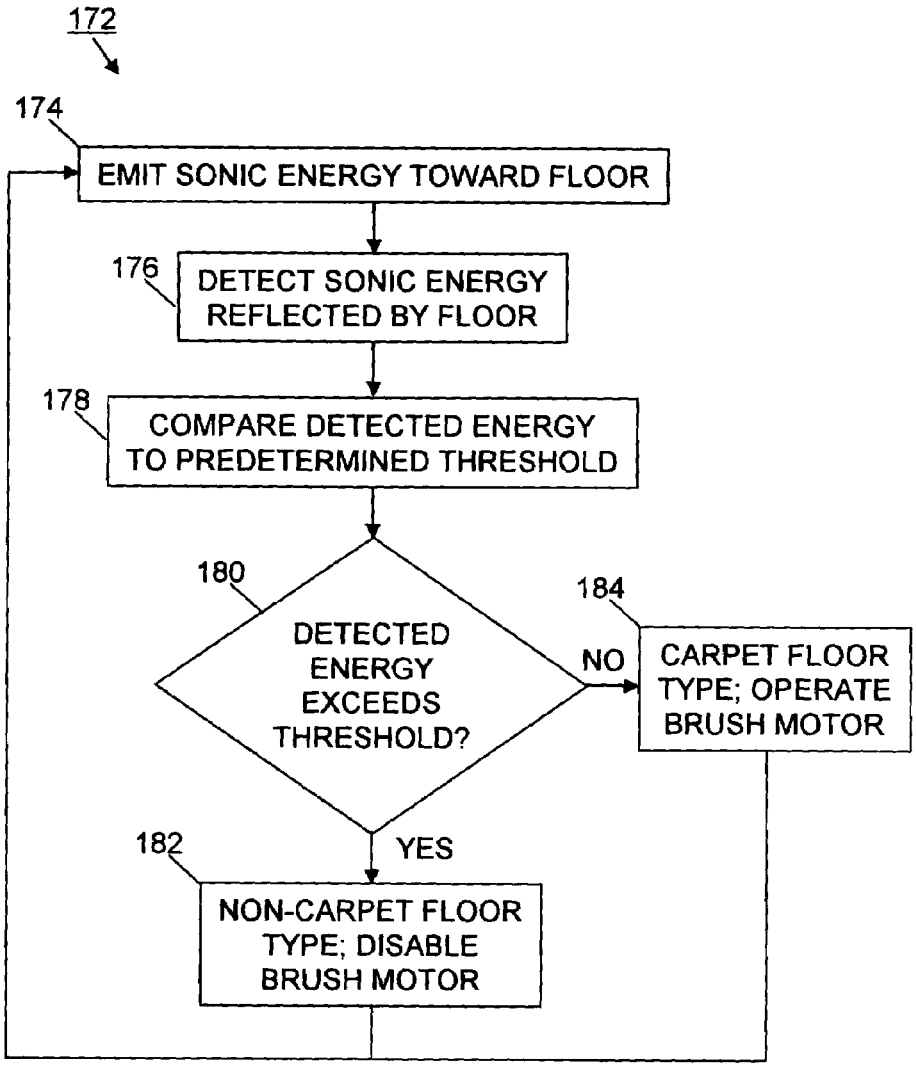
FIG. 10 is a flowchart of an embodiment of a floor type sensing and control process for a vacuum cleaner according to the present invention.

With reference to FIG. 10, a floor type sensing and control process 172 for a vacuum cleaner begins at step 174 when a floor type sensor emits sonic energy toward the floor. Next, at step 176, sonic energy reflected by the floor is detected by the floor type sensor. The detected sonic energy is compared to a predetermined threshold (step 178). At step 180, the process determines whether or not the detected sonic energy exceeds the predetermined threshold. If the detected sonic energy exceeds the predetermined threshold, the floor type is non-carpet or hard and the brush motor is disabled (step 182). Otherwise, the floor type is carpet or soft and the brush motor is operated (step 184). As shown, steps 174-184 are periodically repeated while power is applied to the vacuum cleaner. In an alternate embodiment, the detected sonic energy is compared to a plurality of values in an LUT, each LUT value representing a different type of floor. Depending on the type of floor detected, various predetermined control procedures are activated. For example, a given predetermined control procedure may include adjusting the speed of the brush motor associated with the vacuum cleaner to a preferred speed for that type of floor. Another example of a predetermined control procedure is where the vacuum cleaner is a carpet extractor and the control procedure includes selecting a preferred cleaning solution and/or dispensing a preferred quantity of cleaning solution based on the type of floor being traversed.

Figure 11:
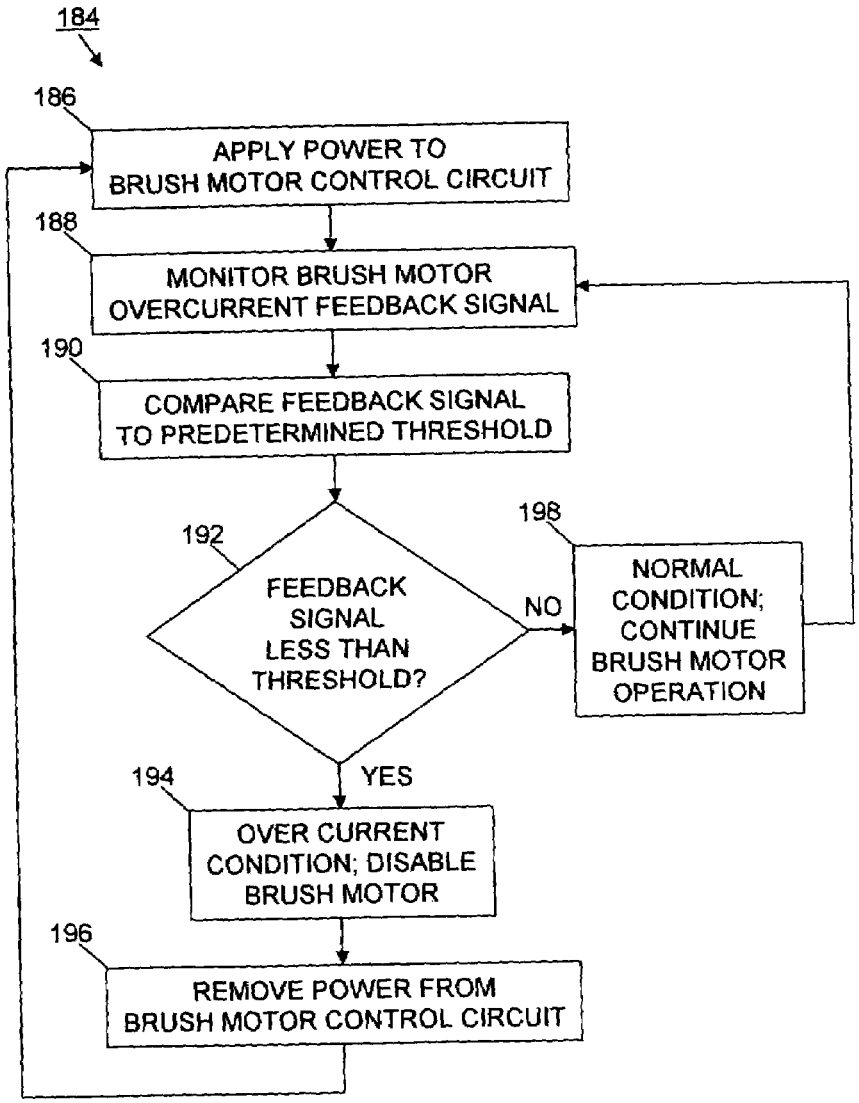
FIG. 11 is a flowchart of an embodiment of a brush motor current sensing and control process for a vacuum cleaner according to the present invention.

With reference to FIG. 11, a brush motor current sensing and control process 184 for a vacuum cleaner begins at step 186 when power is applied to a brush motor control circuit associated with the vacuum cleaner. At step 188, a brush motor overcurrent feedback signal is monitored by a sensor processor via a brush motor overcurrent sensor. The feedback signal, for example, may provide information associated with brush motor RPM, brush motor torque, quantity of brush motor revolutions, and/or distance of brush motor rotation. Next, at step 190, the feedback signal is compared to a predetermined threshold. At step 192, it is determined whether or not the feedback signal is less than the predetermined threshold. If the detected current is less than the threshold, an overcurrent condition exists and the brush motor is disabled (step 194). The brush motor remains disabled until step 196 where power is removed from the brush motor control circuit by some form of manual reset. For example, removing and re-applying power to power and control components associated with the brush motor would suffice as a reset. After the manual reset, the process starts over when power is applied to the brush motor control circuit in step 186.

If the feedback signal is not less than the predetermined threshold in step 192, a normal condition exists and the process advances to step 198. At step 198, brush motor operation continues and the process returns to step 188. Steps 188-198 are periodically repeated while power is applied to the brush motor. The predetermined threshold may provide overcurrent protection for short circuit conditions and/or overload conditions of the brush motor, including locked rotor conditions.

Figure 12:
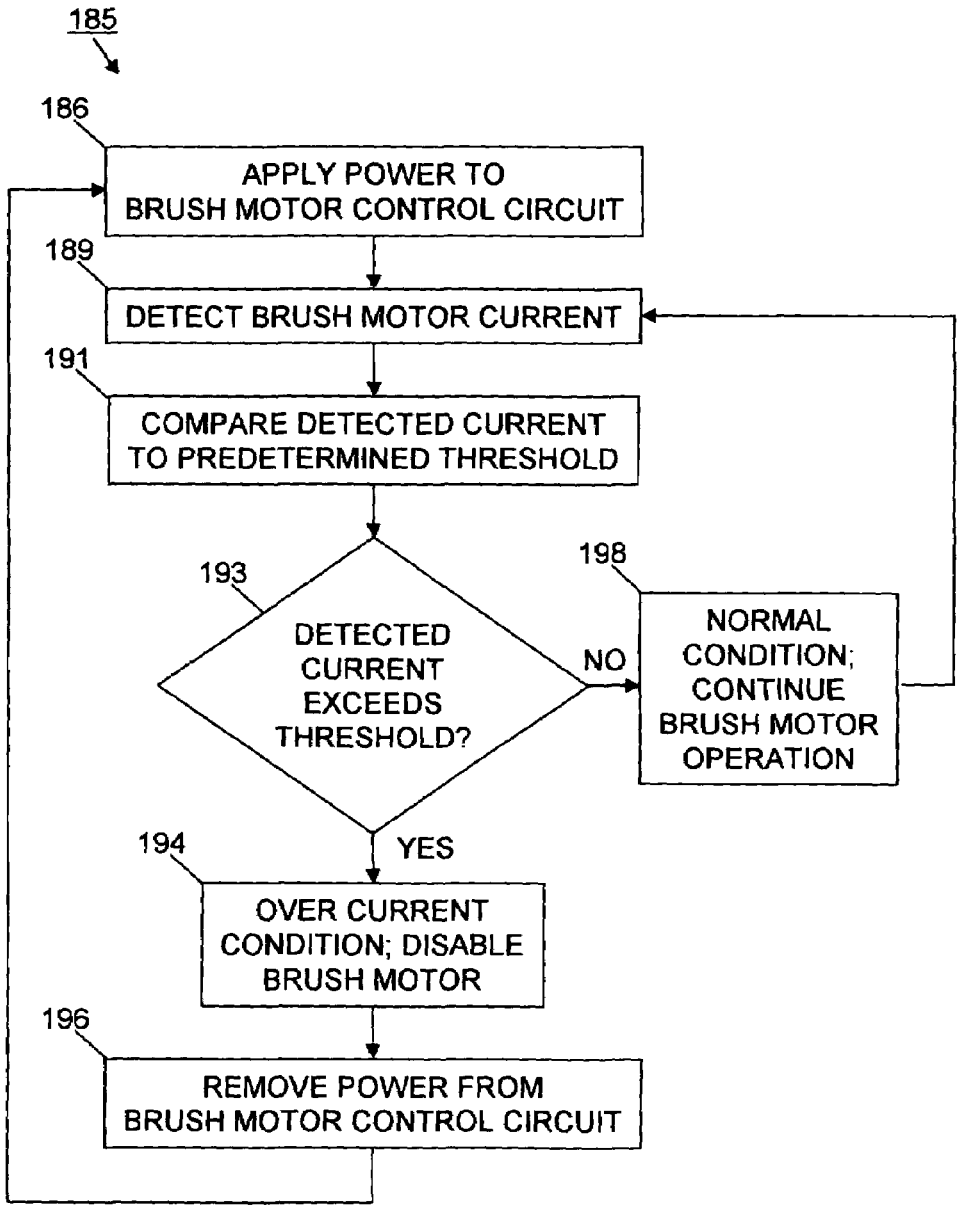
FIG. 12 is a flowchart of another embodiment of a brush motor current sensing and control process for a vacuum cleaner according to the present invention.

With reference to FIG. 12, another embodiment of a brush motor current sensing and control process 185 for a vacuum cleaner begins at step 186 when power is applied to a brush motor control circuit associated with the vacuum cleaner. At step 189, the brush motor current is detected by a brush motor overcurrent sensor. Next, at step 191, the detected brush motor current is compared to a predetermined threshold. At step 193, it is determined whether or not the detected brush motor current exceeds the predetermined threshold. If the detected current exceeds the threshold, an overcurrent condition exists and the brush motor is disabled (step 194). The brush motor remains disabled until step 196 where power is removed from the brush motor control circuit by some form of manual reset. For example, removing and re-applying power to power and control components associated with the brush motor would suffice as a reset. After the manual reset, the process starts over when power is applied to the brush motor control circuit in step 186.

If the detected brush motor current does not exceed the predetermined threshold in step 193, a normal condition exists and the process advances to step 198. At step 198, brush motor operation continues and the process returns to step 188. Steps 188-198 are periodically repeated while power is applied to the brush motor. The predetermined threshold may provide overcurrent protection for short circuit conditions and/or overload conditions of the brush motor, including locked rotor conditions.

Figure 13:
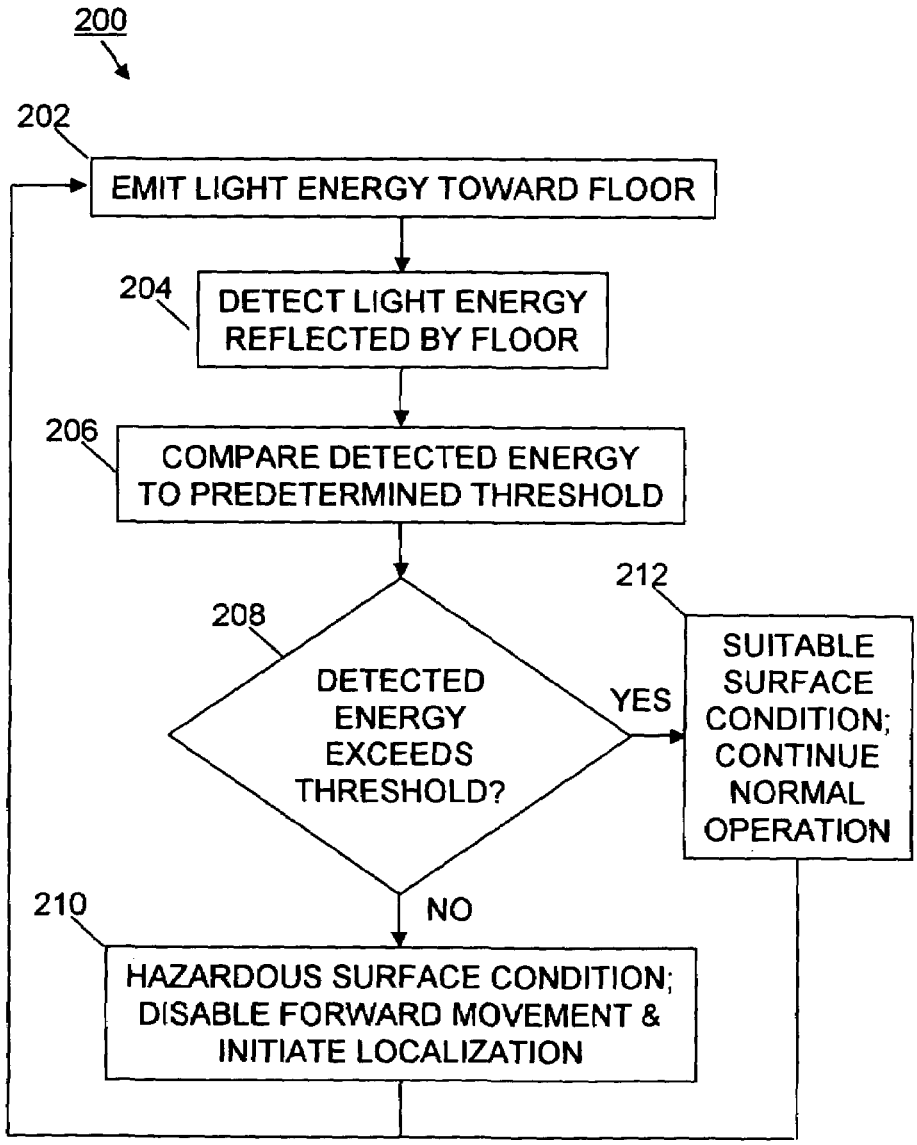
FIG. 13 is a flowchart of an embodiment of a floor loss sensing and control process for a vacuum cleaner according to the present invention.

With reference to FIG. 13, a floor distance sensing and control process 200 for a vacuum cleaner begins at step 202 when light energy is emitted toward a surface of a floor toward which the vacuum cleaner is advancing by a floor distance sensor. Next, at step 204, light energy reflected by the floor is detected by the floor distance sensor. At step 206, the detected light energy is compared to a predetermined threshold. Next, at step 208, the process determines whether the detected light energy exceeds the predetermined threshold. If the detected energy exceeds the threshold, a potential hazardous surface condition exists. Then, at step 210, forward movement of the vacuum cleaner is disabled and a localization routine is initiated. If the detected energy does not exceed the threshold, a suitable surface condition exists and normal operation is continued (step 212). The process continues with steps 202-212 being periodically repeated while the vacuum cleaner is being propelled.

In an alternate embodiment, when a potential hazardous surface condition exists, a predetermined control procedure to avoid the hazardous surface condition may be implemented. For example, the vacuum cleaner may implement an edge following routine where the floor distance sensor is used to avoid proceeding beyond the edge of the potentially hazardous surface condition.

Figure 14:
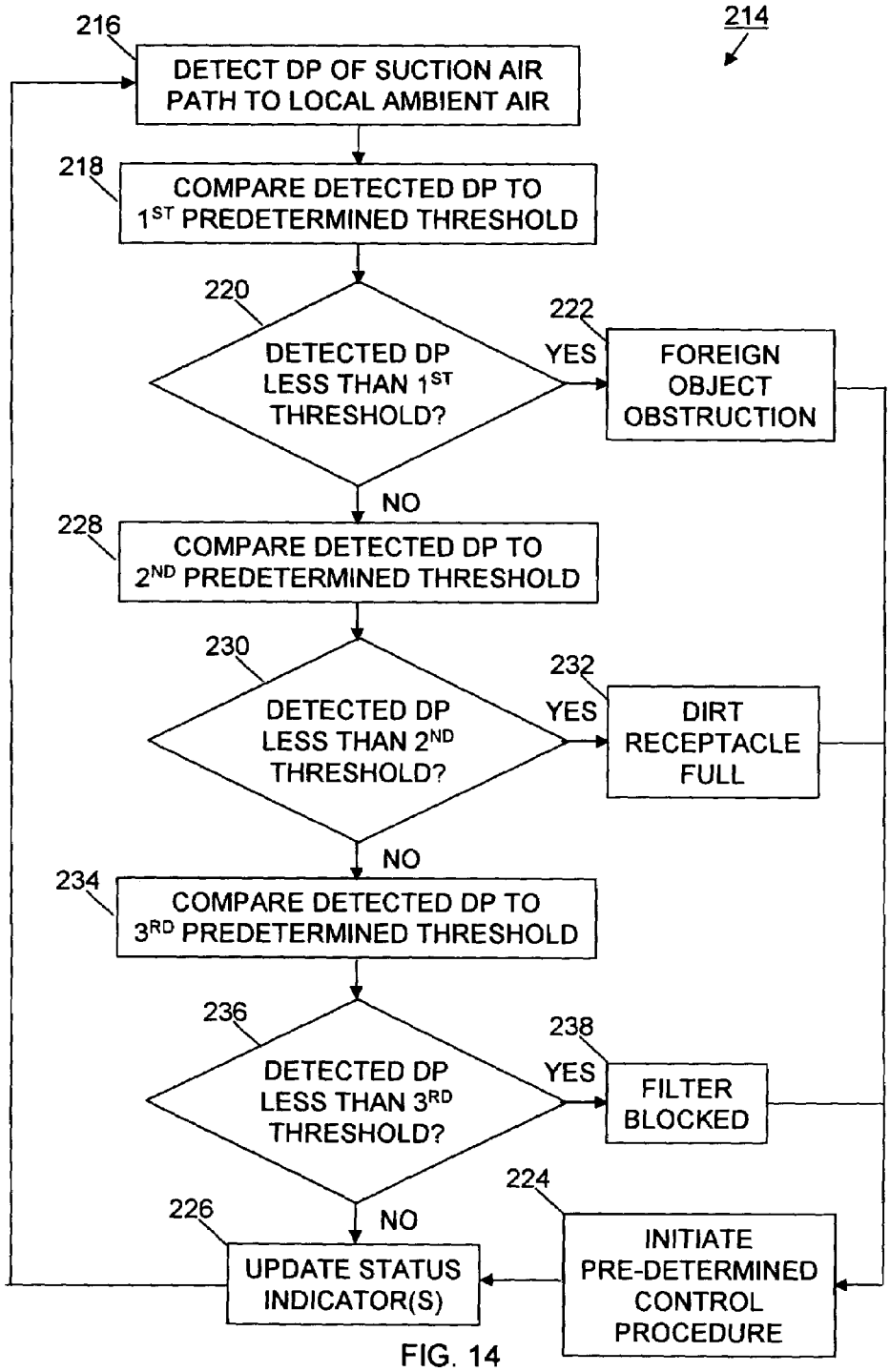
FIG. 14 is a flowchart of an embodiment of a suction airflow sensing and control process for a vacuum cleaner according to the present invention.

With reference to FIG. 14, a suction airflow sensing and control process 214 for a vacuum cleaner begins at step 216 when a differential pressure between a suction airflow path associated with the vacuum cleaner and ambient air near the vacuum cleaner is detected by a suction airflow sensor. At step 218, the detected differential pressure is compared to a first predetermined threshold. At step 220, the process determines whether the detected differential pressure is less than the first predetermined threshold. If the detected pressure is less than the threshold there is a foreign object obstruction in the suction airflow path (step 222). For example, a sock may have been sucked into the suction inlet. Next, a predetermined control procedure is initiated (step 224). For example, the suction motor may be stopped. If the vacuum cleaner includes a brush, the brush motor may also be stopped. Similarly, if the vacuum cleaner is self-propelled and currently moving, the drive motor may also be stopped.

Next, at step 226, status indicators reflecting the condition of the suction airflow path are updated. For example, a display may be illuminated in red and/or an annunciator may sound a unique audible tone sequence associated with a foreign object obstruction.

At step 220, if the detected differential pressure is not less than the threshold, the process advances to step 228 where the detected differential pressure is compared to a second predetermined threshold. Next, at step 230, the process determines whether the detected differential pressure is less than the second threshold. If the detected differential pressure is less than the second threshold, the dirt receptacle associated with the vacuum cleaner is generally full (step 232). In other words, the dirt cup for a bagless system needs to be emptied or the bag for a bag system needs to be removed and replaced. The process continues to step 224 and initiates a predetermined control procedure associated with the dirt receptacle being generally full. Next, the status indicator is updated (step 226). For example, a yellow illuminated display is lit and/or a unique audible tone sequence is sounded.

At step 230, if the detected differential pressure is not less than the second threshold, the process advances to step 234 and the detected differential pressure is compared to a third predetermined threshold. Next, at step 236, the process determines whether the detected differential pressure is less than the third threshold. If the detected differential pressure is less than the third threshold, a filter associated with the vacuum cleaner is generally blocked (step 238). Next, at step 224, a predetermined control procedure associated with conditions when the filter is generally blocked is initiated. At step 226, the status indicator is updated to reflect the blocked filter condition. For example, the illuminated display flashes yellow and/or a unique audible tone sequence associated with the blocked filter condition is sounded At step 236, if the detected differential pressure is not less than the third threshold, the section airflow path is suitable for normal vacuuming operations and the process continues to step 226 where the status indicator is updated. For example, a green illuminated display is lit.

Steps 216-238 are periodically repeated while power is applied to the suction motor. While the process described identifies three predetermined thresholds associated with three unique conditions, other embodiments may include more or less thresholds and associated conditions.

While the invention is described herein in conjunction with several exemplary embodiments, it is evident that many alternatives, modifications, and variations will be apparent to those skilled in the art. Accordingly, the embodiments of the invention in the preceding description are intended to be illustrative, rather than limiting, of the spirit and scope of the invention. More specifically, it is intended that the invention embrace all alternatives, modifications, and variations of the exemplary embodiments described herein that fall within the spirit and scope of the appended claims or the equivalents thereof.

What is claimed is:

1. A vacuum cleaner (10), including:

a housing;

a suction airflow sensor (94), disposed within said housing, for detecting a condition associated with a suction airflow path mounted to the housing;

a sensor processor (90), disposed within said housing, in communication with the suction airflow sensor for evaluating the detected condition, determining whether a responsive action is required, and, when required, initiating a suitable predetermined control procedure in response to the detected condition;

a floor type sensor (97), disposed within said housing, in operative communication with the sensor processor for emitting sonic energy toward a floor being traversed by the vacuum cleaner and detecting sonic energy reflected by the floor, wherein the sensor processor interprets the detected sonic energy to identify a floor type, and initiates a predetermined control procedure based on the type of floor being traversed;

a vacuum source (36, 38), disposed within said housing, for creating the suction airflow path to provide a vacuuming function for collection of dust and dirt particles; and a controller processor (74), disposed within said housing, in communication with the sensor processor for selectively controlling the vacuum source, based at least in part upon information received from the sensor processor;

wherein the suction airflow sensor includes a differential pressure sensor for detecting a difference between a first pressure associated with the suction airflow path and a second pressure associated with ambient air near the vacuum cleaner.

2. The vacuum cleaner as set forth in claim 1, the sensor processor comprising:

means for determining whether the first pressure in the suction airflow path is suitable for normal vacuuming operations based on information provided by the sensor; and a status indicator (164) for indicating whether the vacuum cleaner is able to perform normal vacuuming operations.

3. The vacuum cleaner as set forth in claim 2, the sensor processor comprising:

means for determining whether the suction airflow path is obstructed by a foreign object;

wherein, if the suction airflow path is obstructed by a foreign object, the sensor processor causes a suction motor to stop and updates the status indicator.

4. The vacuum cleaner as set forth in claim 2, the sensor processor comprising:

means for determining whether a dirt receptacle associated with the vacuum cleaner is generally full;

wherein, if the dirt receptacle is generally full, the sensor processor performs a predetermined control procedure and updates the status indicator.

5. The vacuum cleaner as set forth in claim 2, the sensor processor comprising:

means for determining whether a filter associated with the vacuum cleaner is generally blocked, wherein, if the filter is generally blocked, the sensor processor performs a predetermined control procedure and updates the status indicator.

6. The vacuum cleaner as set forth in claim 2 wherein the status indicator includes an illuminated indicator having at least four illuminated display sequences.

7. The vacuum cleaner as set forth in claim 2 wherein the status indicator includes an annunciator having a plurality of audible tone sequences.

8. The vacuum cleaner as set forth in claim 1 wherein the housing is located within the vacuum cleaner, the vacuum cleaner is one of a robotic vacuum cleaner, a robotic canister-like vacuum cleaner, a hand vacuum cleaner, a carpet extractor, a canister vacuum cleaner, a stick vacuum cleaner, an upright vacuum cleaner, and a shop-type vacuum cleaner.

9. The vacuum cleaner as set forth in claim 1, the vacuum cleaner further including:

a movable brush (54) mounted to the housing;

a brush motor (100), disposed within said housing, in operative communication with said brush to operate said brush; and a brush motor controller (134) in operative communication with the controller processor and the brush motor to selectively operate said brush motor and brush to assist in collection of dust and dirt particles.

10. The vacuum cleaner as set forth in claim 9, the vacuum cleaner further including:

an overcurrent sensor (98), disposed within said housing, in communication with the sensor processor and the brush motor for monitoring a characteristic of the brush motor and providing an associated feedback signal to the sensor processor; and a reset switch (140), disposed within said housing, in operative communication with the sensor processor and the brush motor controller for manually resetting power applied to the brush motor and providing a reset switch activation signal to the sensor processor;

wherein the sensor processor compares the feedback signal to a predetermined threshold and, when the feedback signal is less than the predetermined threshold, removes power from the brush motor and disables operation of the brush until power is manually reset.

11. The vacuum cleaner as set forth in claim 10, the overcurrent sensor including:

an overcurrent feedback module (135) in operative communication with the sensor processor and the brush motor for monitoring the brush motor characteristic and providing the feedback signal to the sensor processor.

12. The vacuum cleaner as set forth in claim 10 wherein the brush motor characteristic associated with the feedback signal includes one or more of a brush motor RPM, a brush motor torque, a quantity of brush motor revolutions, and a distance of brush motor rotation.

13. The vacuum cleaner as set forth in claim 9, the vacuum cleaner further including:

an overcurrent sensor (98), disposed within said housing, in communication with the sensor processor and the brush motor for detecting a level of electrical current flowing through the brush motor; and a reset switch (140), disposed within said housing, in operative communication with the sensor processor and the brush motor controller for manually resetting power applied to the brush motor and providing a reset switch activation signal to the sensor processor;

wherein the sensor processor compares the detected current to a predetermined threshold and, when the detected current exceeds the predetermined threshold, removes power from the brush motor and disables operation of the brush until power is manually reset.

14. The vacuum cleaner as set forth in claim 13, the overcurrent sensor including:

an electronic switch (138) in operative communication with the sensor processor and the brush motor for enabling and disabling operation of the brush motor; and a current sense circuit (136) in operative communication with the sensor processor and the brush motor for sensing the level of electrical current flowing through the brush motor.

15. The vacuum cleaner as set forth in claim 9, the floor type sensor further including:

a lookup table (LUT), wherein the floor type sensor compares the detected sonic energy to a plurality of values in the LUT , wherein the LUT values represent a plurality of types of floors, matching the detected sonic energy to a LUT value to determine the type of floor being traversed, and initiating a predetermined control procedure based on the type of floor being traversed.

16. The vacuum cleaner as set forth in claim 15, the vacuum cleaner further including:

a signal generator circuit (124), disposed within said housing, in communication with the sensor processor and the floor type sensor for generating a signal associated with the sonic energy emitted by the floor type sensor;

a signal conditioning circuit (130), disposed within said housing, in communication with the floor type sensor for conditioning a signal associated with the sonic energy detected by the floor type sensor; and a comparator processor (132), disposed within said housing, in communication with the signal conditioning circuit and the sensor processor for comparing the conditioned signal to the LUT values.

17. The vacuum cleaner as set forth in claim 1, the vacuum cleaner further including:

a floor distance sensor (96), disposed within said housing, in operative communication with the sensor processor for emitting light energy toward a surface of a floor toward which the vacuum cleaner is advancing and detecting light energy reflected by the floor; and a drive motor(104), disposed within said housing, in operative communication with the controller processor to selectively operate a drive wheel (50) to propel the vacuum cleaner;

wherein the sensor processor compares the detected light energy to a predetermined threshold and, when the detected light energy is less than the predetermined threshold, stops the drive motor.

18. The vacuum cleaner as set forth in claim 17, the vacuum cleaner further including:

a signal conditioning circuit (146), disposed within said housing, in communication with the floor distance sensor and the sensor processor for conditioning a signal associated with the light energy detected by the floor distance sensor.

19. The vacuum cleaner as set forth in claim 17, further including:

a light detector that receives the amount of light detected by the floor distance sensor and communicates the amount of light to the sensor processor to reverses the drive motor and activates a localization function associated with the vacuum cleaner when the detected light energy is less than the predetermined threshold.

20. A vacuum cleaner (10), including:

a housing;

a vacuum source (36, 38), disposed within said housing, for creating a suction airflow to provide a vacuuming function for collection of dust and dirt particles;

a floor distance sensor (96), disposed within said housing, in operative communication with a sensor processor for emitting light energy toward a surface of a floor toward which the vacuum cleaner is advancing and detecting light energy reflected by the floor; and a drive motor (104), disposed within said housing, in operative communication with a controller processor to selectively operate a drive wheel (50) to propel the vacuum cleaner;

wherein the sensor processor compares the detected light energy to a predetermined threshold and, when the detected light energy is less than the predetermined threshold, stops the drive motor.

* * * * *